US010520230B2

(12) United States Patent
Edwards et al.

(10) Patent No.: US 10,520,230 B2
(45) Date of Patent: Dec. 31, 2019

(54) ENHANCED HEAT TRANSPORT SYSTEMS FOR COOLING CHAMBERS AND SURFACES

(71) Applicant: Phononic, Inc., Durham, NC (US)

(72) Inventors: Jesse W. Edwards, Wake Forest, NC (US); Paul B. McCain, Chapel Hill, NC (US)

(73) Assignee: Phononic, Inc., Durham, NC (US)

( * ) Notice: Subject to any disclaimer, the term of this patent is extended or adjusted under 35 U.S.C. 154(b) by 984 days.

(21) Appl. No.: 14/486,652

(22) Filed: Sep. 15, 2014

(65) Prior Publication Data

US 2015/0075184 A1 Mar. 19, 2015

Related U.S. Application Data

(60) Provisional application No. 61/878,156, filed on Sep. 16, 2013, provisional application No. 62/027,071, filed on Jul. 21, 2014.

(51) Int. Cl.

| | |
|---|---|
| ***F25B 49/00*** | (2006.01) |
| ***F25B 21/02*** | (2006.01) |
| ***F28F 27/00*** | (2006.01) |

(52) U.S. Cl.

CPC ..... *F25B 21/02* (2013.01); *F28F 27/00* (2013.01); *F25B 2321/02* (2013.01)

(58) Field of Classification Search

CPC ..... F28D 15/06; F28D 15/02; F25B 21/02
See application file for complete search history.

(56) References Cited

U.S. PATENT DOCUMENTS 2,947,150 A * 8/1960 Roeder, Jr. ..... F25B 21/02 136/204
5,918,474 A 7/1999 Khanpara
5,931,011 A 8/1999 Shima et al.
(Continued)

FOREIGN PATENT DOCUMENTS

CN 201876041 U 6/2011
JP S5778731 A 5/1982
(Continued)

OTHER PUBLICATIONS

First Office Action for Chinese Patent Application No. 201480051943.5, dated May 11, 2017, 8 pages.
(Continued)

*Primary Examiner* — Ljiljana V. Ciric
*Assistant Examiner* — Alexis K Cox
(74) *Attorney, Agent, or Firm* — Withrow & Terranova, PLLC

(57) ABSTRACT

At least one forced convection unit added to a passive heat transport system is operated during transient heat loading periods but not operated under steady state conditions for cooling and maintaining a set point temperature of a chamber or surface. Forced convection is selectively employed based on temperature data and/or set point temperature values. A reject heat transport system includes first and second reject heat sinks each coupled via main and cross-over transport tubes to first and second reject heat exchangers, permitting both heat sinks to dissipate heat from first and second thermoelectric heat pumps regardless of whether the first, the second, or the first and second heat pumps are in operation.

9 Claims, 15 Drawing Sheets

(56) References Cited

U.S. PATENT DOCUMENTS

| | | | | |
|---|---|---|---|---|
| 6,549,408 | B2 | 4/2003 | Berchowitz | |
| 7,032,389 | B2 | 4/2006 | Cauchy | |
| 8,216,871 | B2 | 7/2012 | McCann | |
| 8,763,408 | B2 | 7/2014 | Ma et al. | |
| 2003/0029174 | A1 | 2/2003 | Lee | |
| 2004/0065100 | A1* | 4/2004 | Jacobsen | B60H 1/3232 62/228.1 |
| 2007/0012055 | A1 | 1/2007 | Schenk et al. | |
| 2013/0174577 | A1 | 7/2013 | Brija et al. | |
| 2013/0219930 | A1* | 8/2013 | Shin | F25B 29/003 62/79 |
| 2013/0291555 | A1 | 11/2013 | Edwards et al. | |
| 2013/0291564 | A1 | 11/2013 | Ghoshal et al. | |

FOREIGN PATENT DOCUMENTS

| | | | |
|---|---|---|---|
| JP | S5840465 | A | 3/1983 |
| JP | S58183464 | U | 12/1983 |
| JP | H04174269 | A | 6/1992 |
| JP | H05312454 | A | 11/1993 |
| JP | H11201614 | A | 7/1997 |
| JP | H10111059 | A | 4/1998 |
| JP | H10300305 | A | 11/1998 |
| JP | H11325689 | A | 11/1999 |
| JP | 2003139464 | A | 5/2003 |
| JP | 2008180453 | A | 8/2008 |
| JP | 2013069890 | A | 4/2013 |
| WO | 2012033476 | A1 | 3/2012 |
| WO | 2012169989 | A1 | 12/2012 |
| WO | 2013074057 | A1 | 5/2013 |
| WO | 2013169874 | A1 | 11/2013 |

OTHER PUBLICATIONS

Author Unknown, "Thermoelectric Technical Reference—Heat Sink Considerations," FerroTec.com, Accessed Aug. 11, 2014, 2 pages.

Dousti, M. J. et al., "Power-Aware Deployment and Control of Forced-Convection and Thermoelectric Coolers," DAC '14, Jun. 1-5, 2014, San Francisco, California, 6 pages.

Ghoshal, U. et al., "Efficient Switched Thermoelectric Refigerators for Cold Storage Applications," Journal of Electronic Materials, Mar. 4, 2009, 6 pages.

Invitation to Pay Additional Fees and Partial International Search for PCT/US2014/055634, dated Jan. 7, 2015, 6 pages.

International Preliminary Report on Patentability for International Patent Application No. PCT/US2014/055634, dated Dec. 10, 2015, 8 pages.

International Search Report and Written Opinion for PCT/US2014/055634, dated Apr. 1, 2015, 14 pages.

Written Opinion for PCT/US2014/055634, dated Sep. 11, 2015, 5 pages.

Notice of Reasons for Refusal for Japanese Patent Application No. 2016-542851, dated Jul. 24, 2018, 19 pages.

Çengel, Y. et al., "Thermodynamics: An Engineering Approach," Fourth Edition, Mcgraw-Hill College, 2001, p. 247.

Notice of Reasons for Refusal for Japanese Patent Application No. 2016-542851, dated Mar. 12, 2019, 6 pages.

Decision to Grant a Patent for Japanese Patent Application No. 2016-542851, dated Jun. 4, 2019, 6 pages.

* cited by examiner

ENHANCED HEAT TRANSPORT SYSTEMS FOR COOLING CHAMBERS AND SURFACES

RELATED APPLICATIONS

This application claims the benefit of U.S. Provisional Patent Application No. 61/878,156 filed on Sep. 16, 2013, and of U.S. Provisional Patent Application No. 62/027,071 filed on Jul. 21, 2014. The disclosures of the foregoing applications are hereby incorporated by reference herein in their respective entireties.

TECHNICAL FIELD OF THE DISCLOSURE

This disclosure relates generally to cooling systems for removing and dissipating heat from chambers and/or surfaces, including cooling systems and refrigeration systems utilizing thermoelectric cooling elements.

BACKGROUND

The process of refrigeration involves moving heat from a chamber or surface to be cooled, and rejecting that heat at a higher temperature than an ambient medium (e.g., air). Vapor compression-based cooling systems have a high coefficient of performance (COP) and are commonly used for cooling chambers and surfaces. Conventional vapor compression-based refrigeration systems utilize a thermostatically regulated duty cycle control. Such systems typically are not dynamic enough to meet both steady state and transient demand (such as during pull down or recovery), and therefor include excess cooling capacities that far exceed heat extraction demand required during steady state operation. Excess cooling capacity allows improved pull down performance, but due to the nature of their control, thermodynamic limits, and product performance demands, conventional vapor compression systems are less efficient than optimum. Excess cooling capacity also entails large current surges during start-up and requires more expensive electrical components.

The sub-optimum efficiencies of vapor compression-based refrigeration systems relate to the desire for such systems to precisely control the temperature within a cooling chamber. Typically, when a temperature within a cooling chamber exceeds a specified value a vapor compression-based refrigeration system is activated and continues to run until the temperature in the cooling chamber is below the specified value—at which point the vapor compression-based system is turned off. This type of control scheme typically has a relatively large control band and a relatively large internal temperature stratification to seek to minimize energy consumption and allow for operation in varied ambient conditions. Such a control scheme is most often utilized because throttling or capacity variation is difficult and expensive to implement with the vapor compression cycle, and throttling or capacity variation provides limited efficacy as volumetric efficiency falls.

Vapor compression based systems also frequently use chlorofluorocarbon (CFC)-based refrigerants; however, the use of CFC-based refrigerants pose an environmental threat since release of such compounds may lead to depletion of the Earth's ozone layer.

Thermoelectric cooling systems represent an environmentally friendly alternative to vapor compression systems, since they do not require CFC-based refrigerants. Thermoelectric coolers (also known as thermoelectric heat pumps) produce a temperature difference across surfaces thereof in response to application of an electric current. Heat may be accepted from a surface or chamber to be cooled, and may be transported (e.g., via a series of transport pipes) to a reject heat sink for dissipation to an ambient medium such as air. Thermoelectric cooling systems may include passive heat reject subsystems. such as thermosiphons or heatpipes, that dispense with a need for forced transport of pressurized coolant though a reject heat sink. As with all refrigeration systems, the smaller the temperature difference across a thermoelectric heat pump, the more efficient the heat pump will be at transporting heat. Despite the environmental benefits of thermoelectric cooling systems, however, such systems have COP values that are typically less than half of vapor compression systems. Enhancing COP of thermoelectric cooling systems and enabling their use over a wide range of ambient temperature conditions would be beneficial to promote increased adoption of such systems.

SUMMARY

Embodiments of the present disclosure relate to heat transport systems (including thermoelectric cooling systems) enabling greater efficiency and/or usage over an increased range of ambient temperature conditions, such as may be useful for cooling chambers and/or surfaces.

In certain embodiments according to the present disclosure, at least one forced convection unit is utilized with a passive heat transport system (e.g., using a thermosiphon or heatpipe) for maintaining a set point temperature or set point temperature range of a chamber or surface, with the at least one forced convection unit being operated during periods of high heat loading (e.g., transient conditions) and/or high temperature reject conditions, but not operated during normal (e.g., steady state) conditions when passive heat transport may be sufficient for heat to be accepted from the surface or chamber to be cooled, and/or for heat to be rejected to an ambient environment. The at least one forced convection unit is selectively operated to enhance or boost convective heat transport relative to at least one heat exchanger in thermal communication with a heat transport fluid. At least one forced convection unit may be arranged proximate to at least one heat exchanger at the accept side and/or at the reject side of a heat transport system. A controller receives temperature data indicative of at least one of (i) temperature of an ambient environment containing the heat transport system, and (ii) temperature of a chamber or surface to be cooled. The controller activates at least one forced convection unit upon detection of a condition indicative of at least one of the following states: temperature of the chamber or surface exceeds a steady state temperature range that includes the set point temperature or set point temperature range, and/or temperature of an ambient environment exceeds an ambient environment threshold temperature or ambient environment threshold temperature range. The controller deactivates at least one forced convection unit upon detection of a condition indicative of at least one of the following states: temperature of the chamber or surface is within the steady state temperature range, and/or temperature of an ambient environment is below the ambient environment threshold temperature or ambient environment threshold temperature range.

In certain embodiments according to the present disclosure, a heat transport apparatus includes multiple reject heat sinks arranged in thermal communication, via main and crossover reject transport tubes, with multiple heat exchangers, each having a plurality of fins and each coupled to at least one different thermoelectric heat pump. All reject heat sinks are arranged to dissipate heat from each thermoelectric heat pump regardless of whether the thermoelectric heat pumps are operated separately or together. As compared to use of reject heat sinks that are dedicated to separate heat exchangers (each having dedicated thermoelectric coolers), the greater surface area associated with the multiple reject heat sinks enhances heat transfer and results in lower temperature at the thermoelectric heat pump(s) in operation. Multiple reject transport tubes are provided, including: at least one first main reject transport tube arranged to transport heat from a first reject heat exchanger to a first reject heat sink, at least one first crossover reject transport tube arranged to transport heat from the first reject heat exchanger to a second reject heat sink, at least one second main reject transport tube arranged to transport heat from the second reject heat exchanger to the second reject heat sink, and at least one second crossover reject transport tube arranged to transport heat from the second reject heat exchanger to the first reject heat sink.

In certain embodiments, any aspects or features as disclosed herein may be combined for additional advantage. Any of the various features and elements as disclosed herein may be combined with one or more other disclosed features and elements unless indicated to the contrary herein Those skilled in the art will appreciate the scope of the present disclosure and realize additional aspects thereof after reading the following detailed description of the preferred embodiments in association with the accompanying drawing figures.

BRIEF DESCRIPTION OF THE DRAWING FIGURES

The accompanying drawing figures incorporated in and forming a part of this specification illustrate several aspects of the disclosure, and together with the description, serve to explain the principles of the disclosure.

Figure 6:
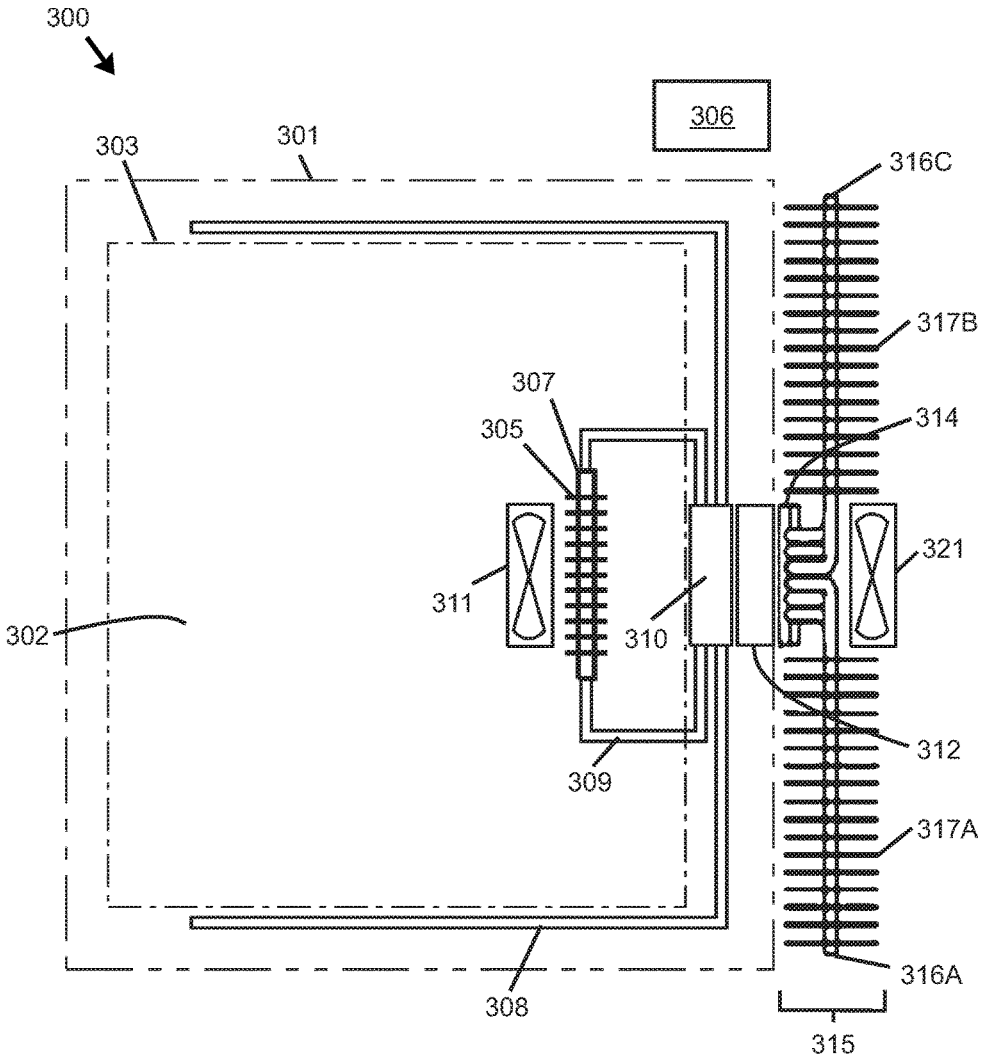

FIG. 6 is a top plan schematic view of a thermoelectric cooling or refrigeration system including a cooling chamber, a first forced convection unit arranged to enhance heat transport to a cold side heat sink within the cooling chamber, a thermoelectric heat exchange assembly incorporating TECs, and a second forced convection unit to enhance dissipation of heat from a hot side heat sink according to one embodiment of the present disclosure.

Figure 7:
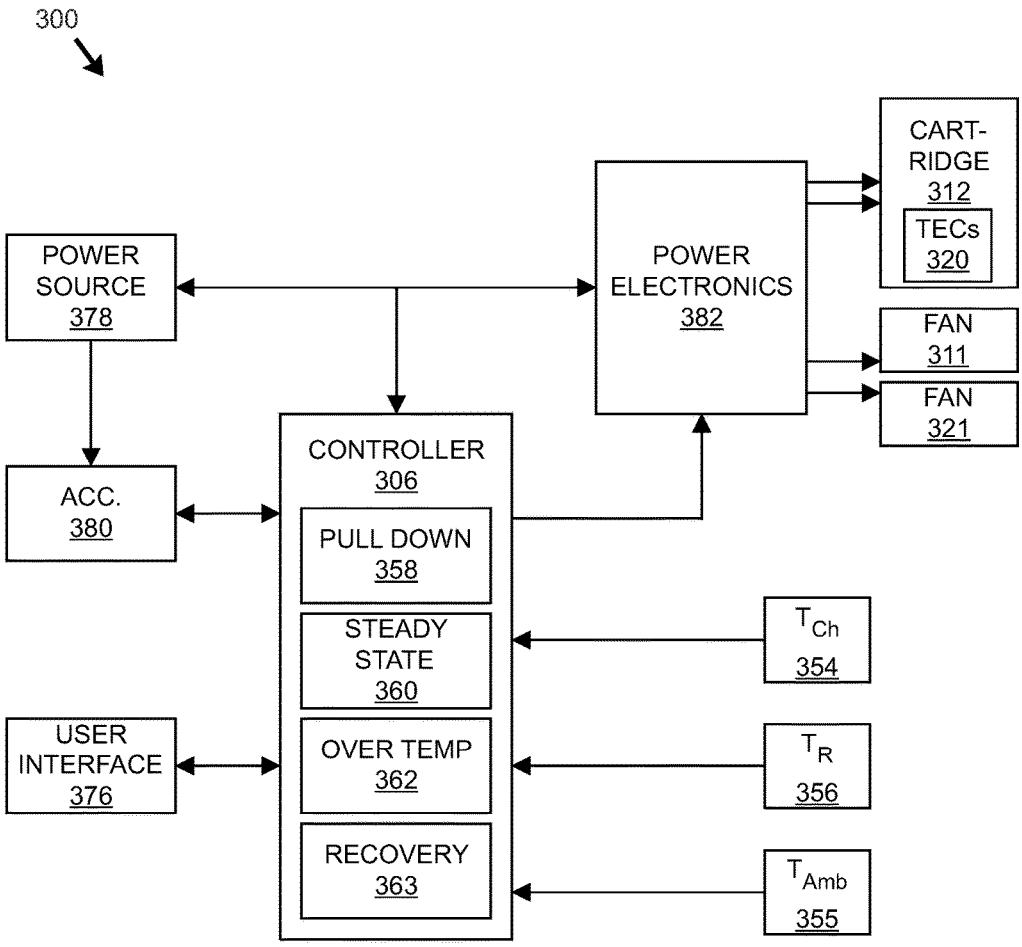

FIG. 7 is a schematic diagram illustrating interconnections between power, sensory, control, and user interface components of a thermoelectric cooling or refrigeration system such as the system of FIG. 6 according to one embodiment of the present disclosure.

Figure 8:
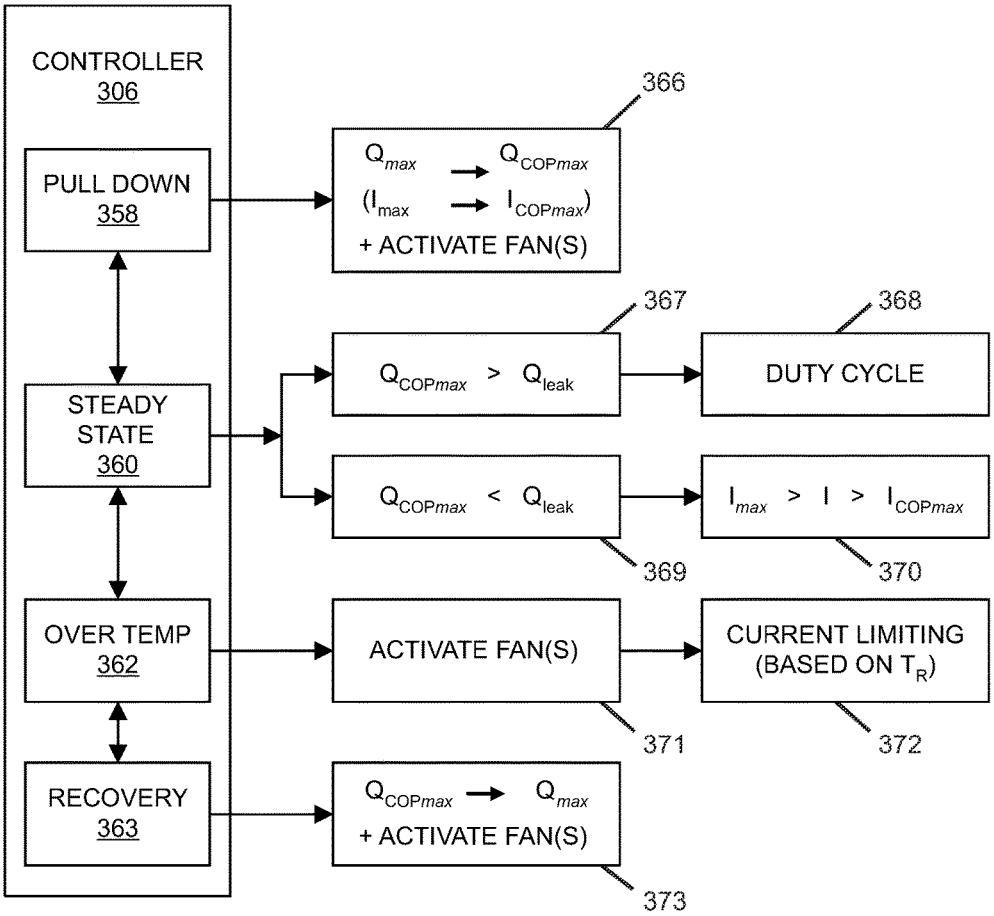

FIG. 8 is a schematic diagram illustrating modes of operation of the controller of the thermoelectric cooling system depicted in FIG. 7.

Figure 9:
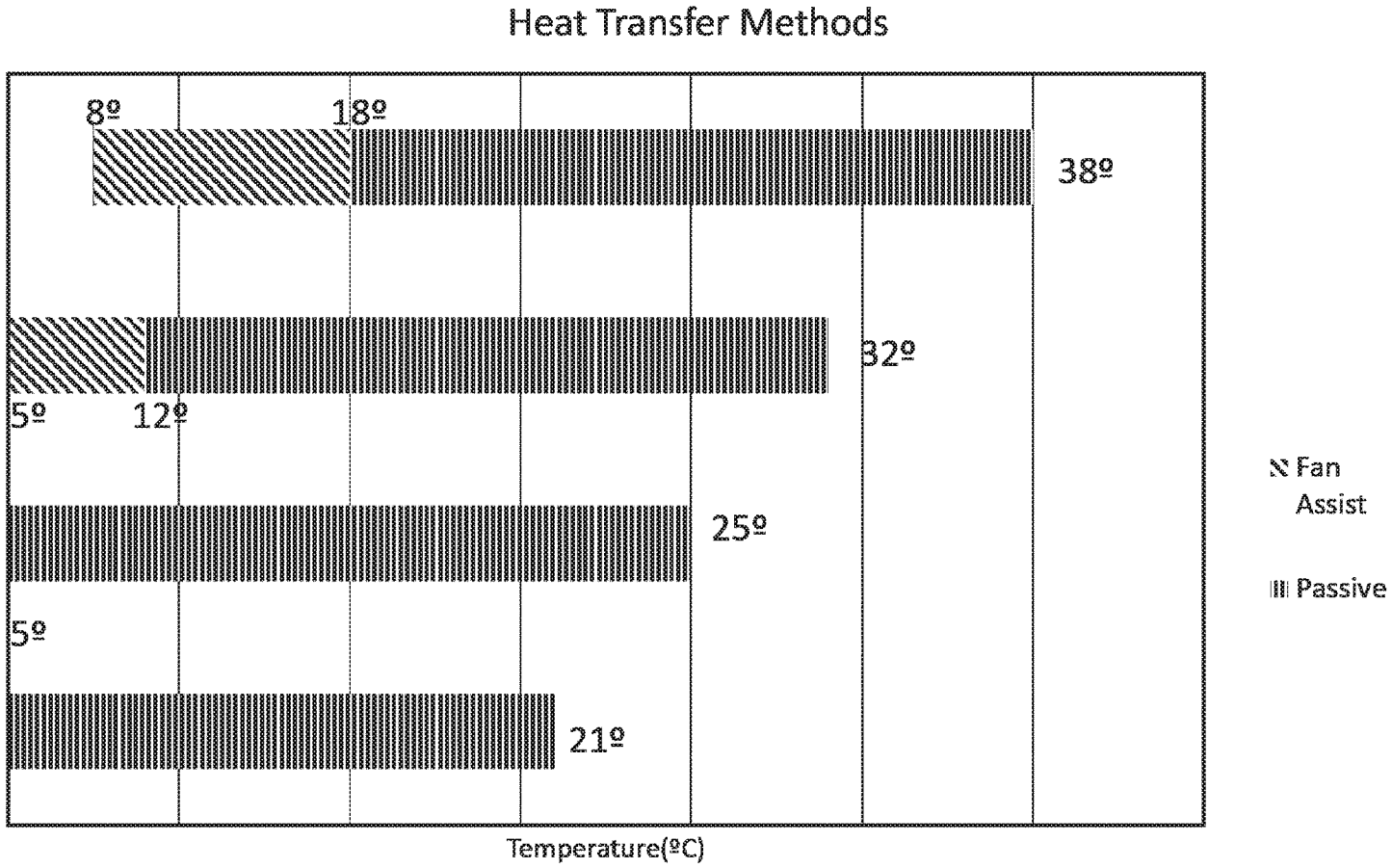

FIG. 9 is a bar graph illustrating conditions under which a thermoelectric cooling system may be operated in fan assist mode (with forced convection) and in passive mode (without forced convection).

Figure 10:
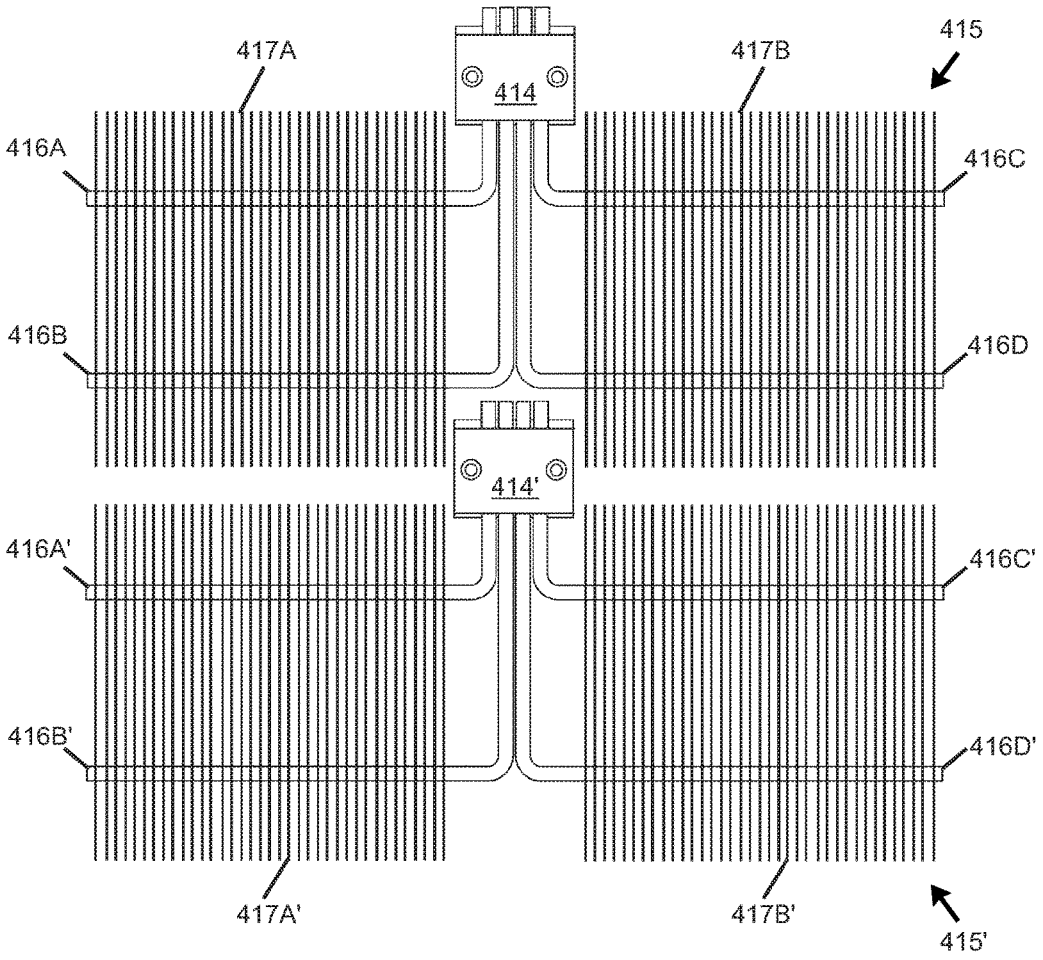
Figure 11:
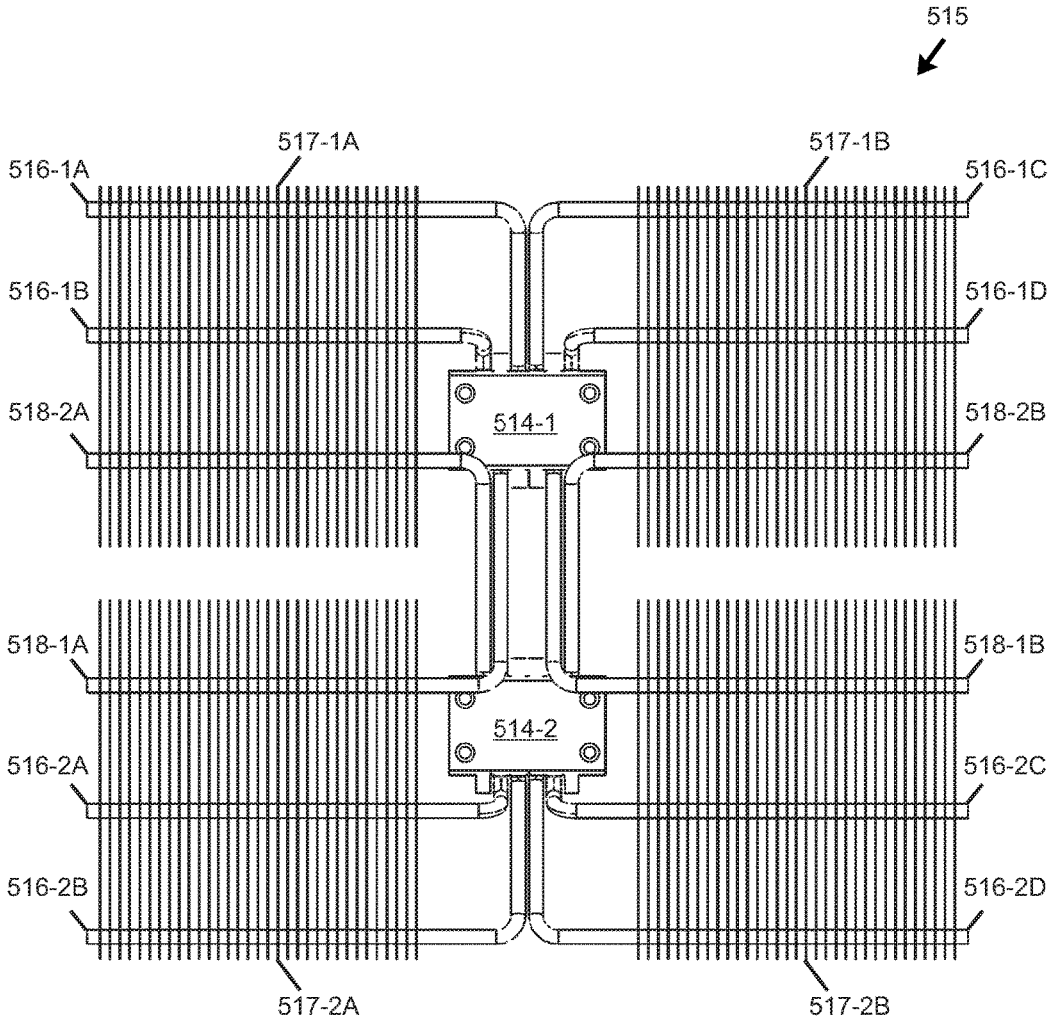
Figure 12:
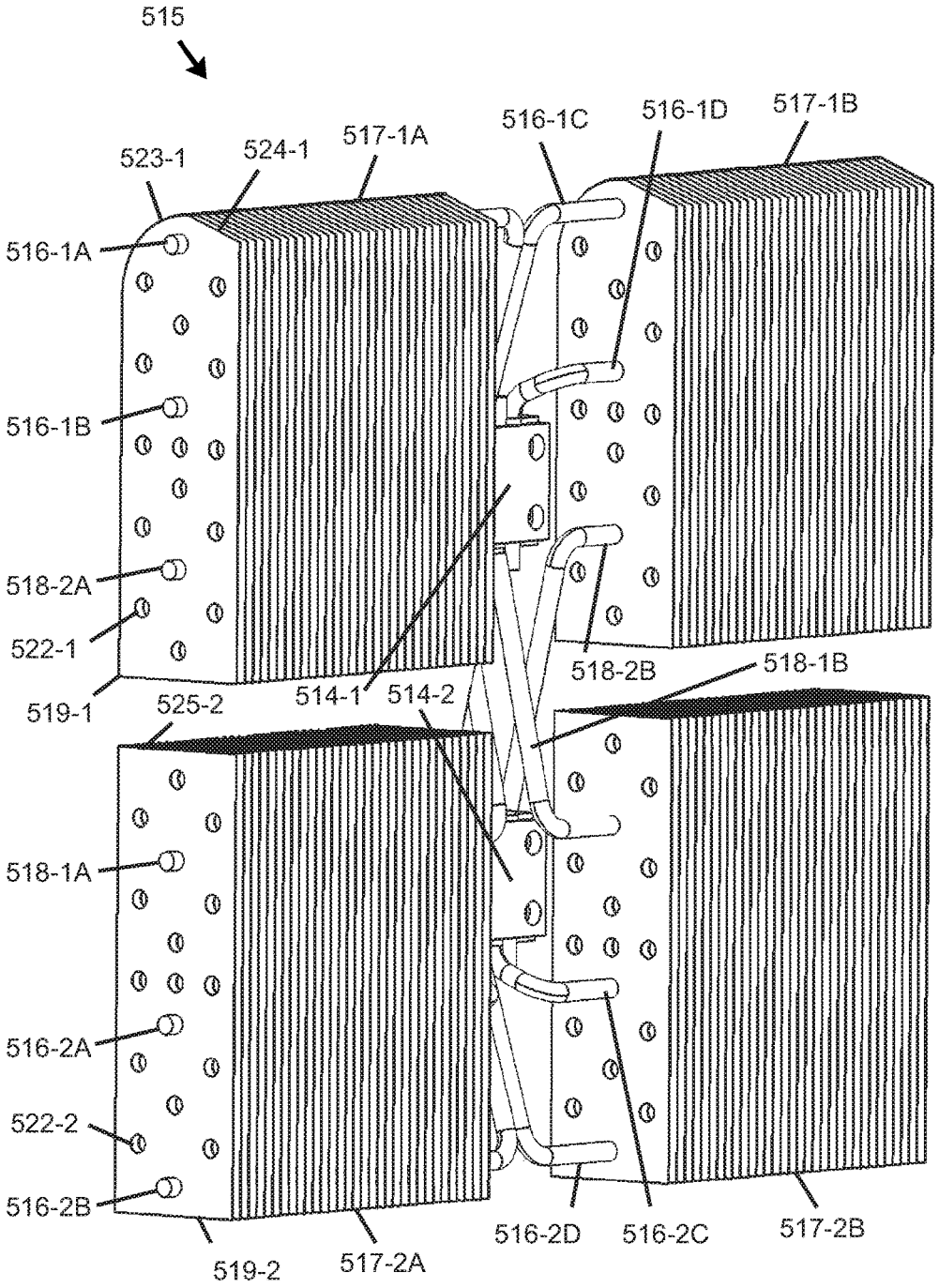

FIG. 10 is a front elevation view of independent first and second heat transport devices, each including a heat sink, a heat exchange pad, and a heat transport conduit, suitable for use with first and second TECs of a thermoelectric cooling or refrigeration system, providing a basis for comparing the heat transport apparatus include linked heat sinks with crossover heat exchange conduits according to FIGS. 11-12.

FIG. 11 is a front elevation view of a heat transport apparatus including linked first and second heat sinks with crossover heat exchange conduits and heat exchange pads suitable for use with first and second TECs (or thermoelectric heat pumps) of a thermoelectric cooling or refrigeration system according to one embodiment of the present disclosure.

FIG. 12 is a perspective view of the heat transport apparatus of FIG. 11.

Figure 13:
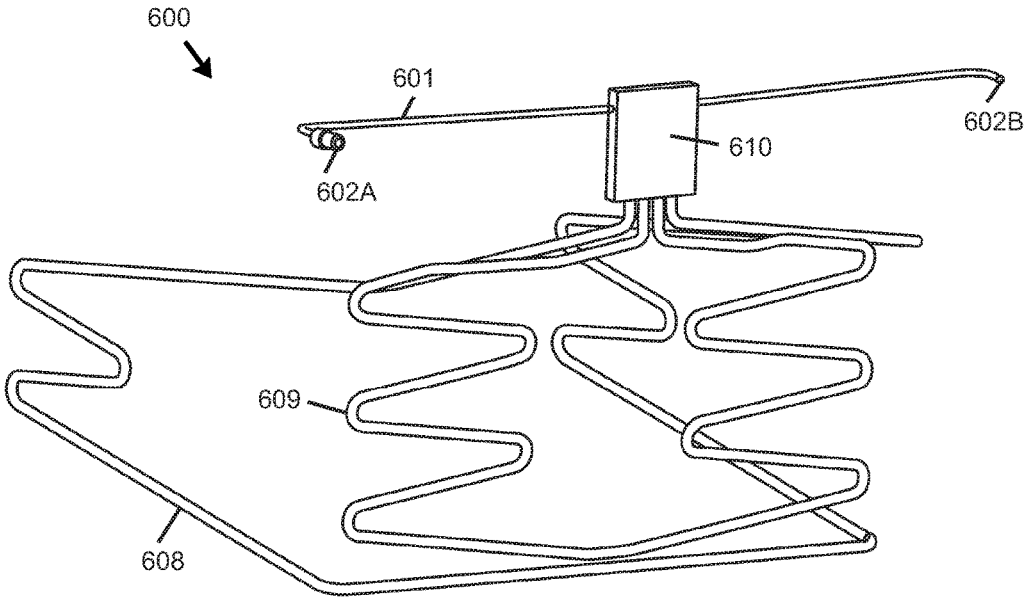
Figure 15:
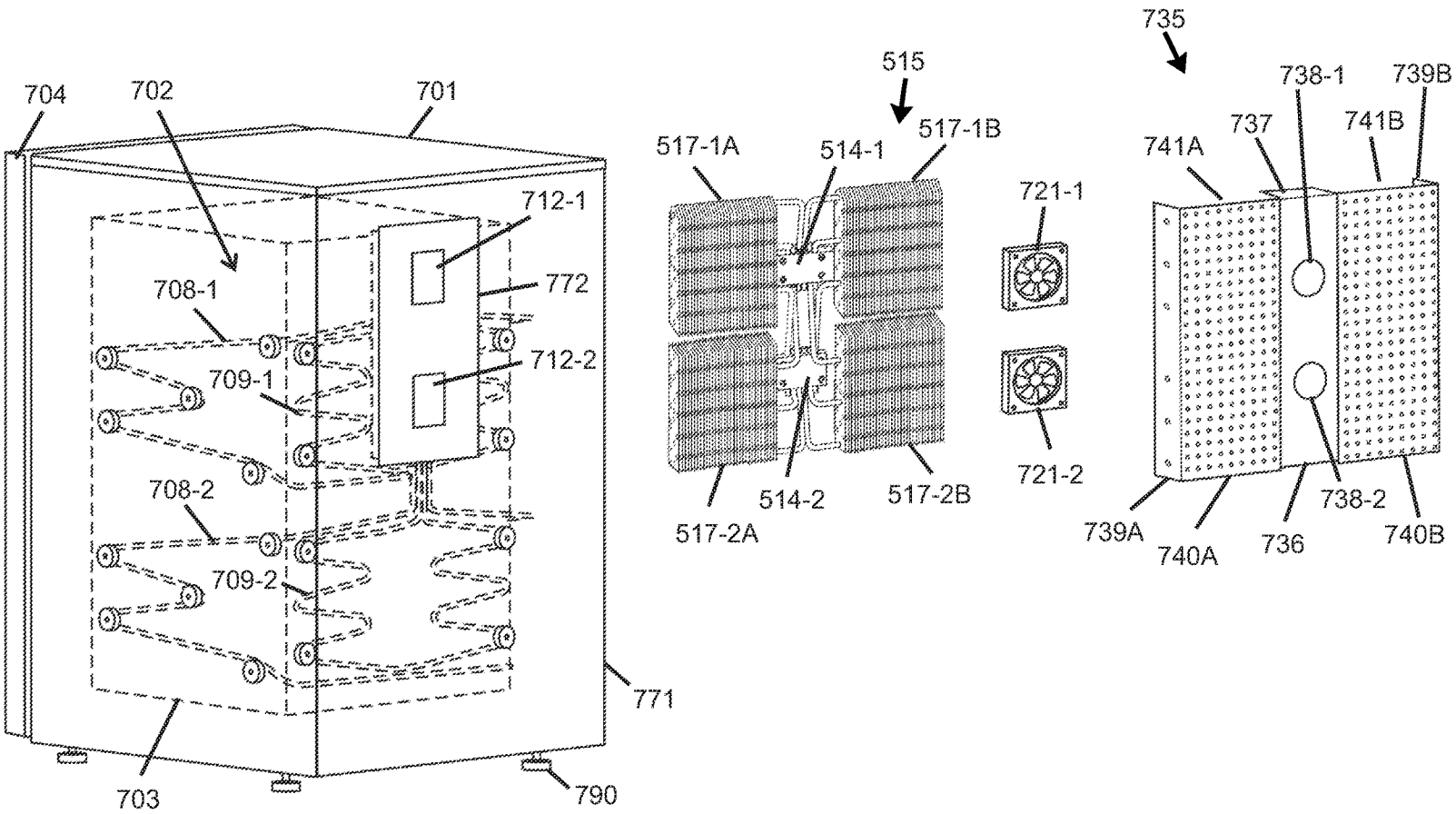
Figure 16:
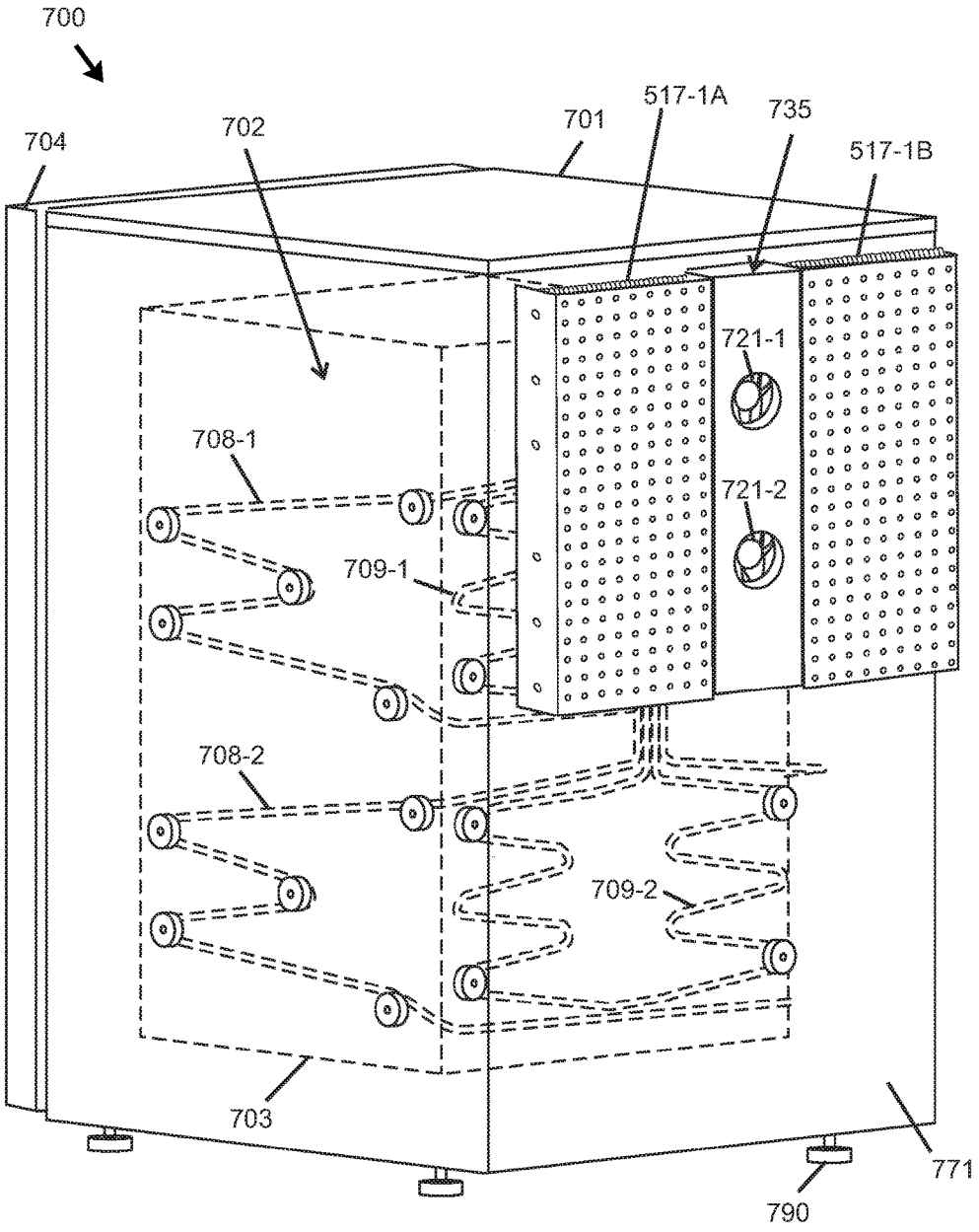

FIG. 13 is a perspective view of fluid conduits and a heat exchange pad of a heat accepting apparatus according to one embodiment of the present disclosure and suitable for use with a thermoelectric refrigerator unit as depicted in FIGS. 15-16.

Figure 14:
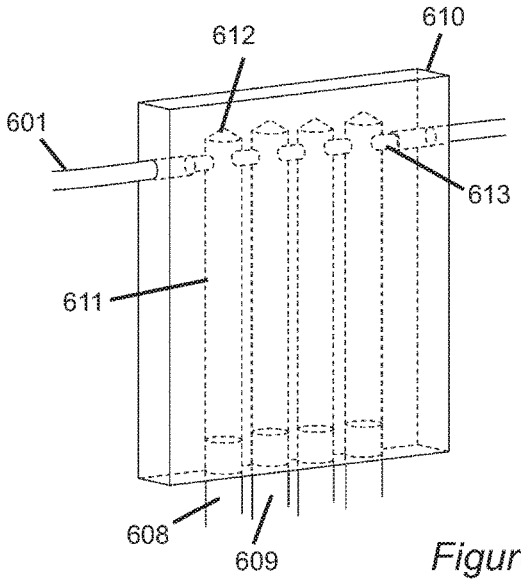

FIG. 14 is a perspective view showing internal elements of the heat exchange block of the heat accepting apparatus of FIG. 13.

FIG. 15 is a perspective assembly view of a thermoelectric refrigeration unit, first and second hot side heat sinks with crossover heat exchange conduits, cooling fans, and a cover arranged to fit over the heat sinks and cooling fans according to one embodiment of the present disclosure.

FIG. 16 is a perspective view of the assembled thermoelectric refrigeration unit depicted in FIG. 15.

DETAILED DESCRIPTION

The embodiments set forth below represent the necessary information to enable those skilled in the art to practice the embodiments and illustrate the best mode of practicing the embodiments. Upon reading the following description in light of the accompanying drawing figures, those skilled in the art will understand the concepts of the disclosure and will recognize applications of these concepts not particularly addressed herein. It should be understood that these concepts and applications fall within the scope of the disclosure and the accompanying claims.

It will be understood that although the terms first, second, etc., may be used herein to describe various elements, these elements should not be limited by these terms. These terms are only used to distinguish one element from another. For example, a first element could be termed a second element, and, similarly, a second element could be termed a first element, without departing from the scope of the present disclosure. As used herein, the term "and/or" includes any and all combinations of one or more of the associated listed items.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises," "comprising," "includes," and/or "including" when used herein specify the presence of stated features, steps, operations, elements, and/or components, but do not preclude the presence or addition of one or more other features, steps, operations, elements, components, and/or groups thereof.

Unless otherwise defined, all terms (including technical and scientific terms) used herein have the same meaning as commonly understood by one of ordinary skill in the art to which this disclosure belongs. It will be further understood that terms used herein should be interpreted as having a meaning that is consistent with their meaning in the context of this specification and the relevant art, and will not be interpreted in an idealized or overly formal sense unless expressly so defined herein.

Figure 1:
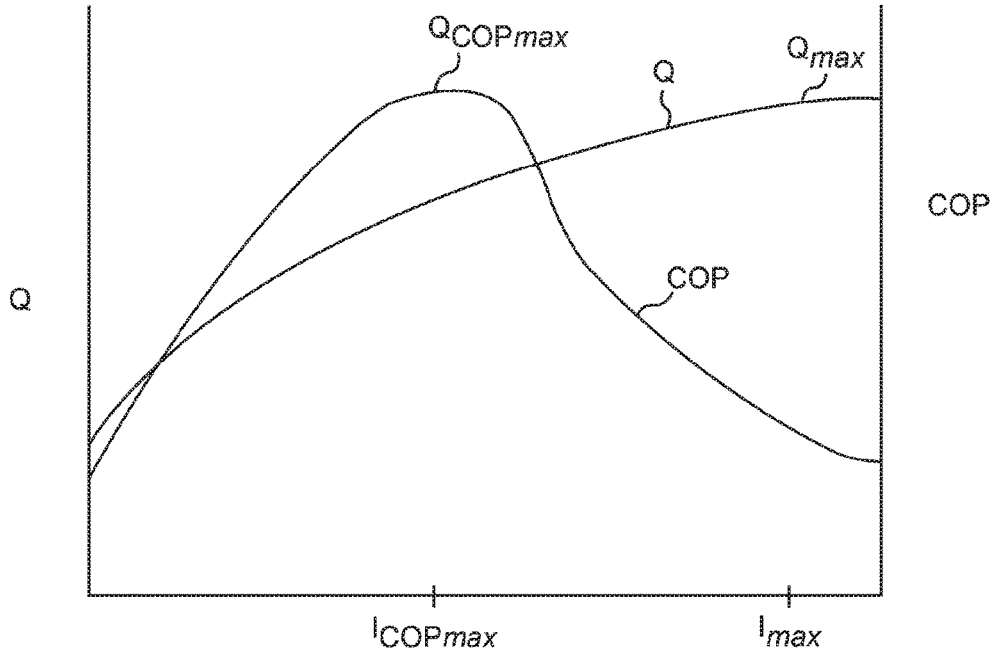
FIG. 1 is a line graph illustrating cooling capacity (Q) and cooling efficiency (COP) of a Thermoelectric Cooler (TEC) as a function of input current to the TEC.

A brief discussion of a cooling capacity and efficiency-versus-input current supplied to a TEC (which may also be called a thermoelectric heat pump) may be beneficial to provide context and aid understanding of the disclosure. FIG. 1 is a line graph illustrating cooling capacity (Q) and cooling efficiency (represented by a Coefficient of Performance (COP)) of a TEC versus an input current supplied to the TEC. As the input current (I) of the TEC increases, the cooling capacity of the TEC also increases. The point on the cooling capacity (Q) curve representing where a maximum amount of heat is being removed by the TEC is denoted as $Q_{max}$. Thus, when the TEC is operating at $Q_{max}$, the TEC is removing the greatest amount of heat possible. The TEC operates at $Q_{max}$ when a corresponding maximum current $I_{max}$ is provided to the TEC. FIG. 1 also illustrates the COP of the TEC as a function of input current (I). For cooling applications, the COP of a TEC is a ratio of heat removed over an amount of work (energy) input to the TEC to remove the heat. The amount of heat, or capacity, (Q) at which the COP of the TEC is maximized is denoted as $Q_{COPmax}$. The TEC operates at $Q_{COPmax}$ when a current $I_{COPmax}$ is provided to the TEC. Thus, the efficiency (or COP) of the TEC is maximized when the current $I_{COPmax}$ is provided to the TEC such that the TEC operates at $Q_{COPmax}$.

As discussed below in detail, in preferred embodiments, a controller is arranged to control TECs (e.g., within one or more cartridges) such that during steady state operation, one or more of the TECs are activated and operated at $Q_{COPmax}$ and the remaining TECs are deactivated to maximize efficiency. The number of TECs activated, and conversely the number of TECs deactivated, is dictated by demand. Conversely, during a transient condition such as pull down or recovery, one or more (and possibly all) TECs are activated and operated according to a desired performance profile. One example of a desired performance profile involves activation and operation of all present TECs at $Q_{max}$ in order to minimize pull down or recovery time. However, another desired performance profile may alternatively provide a tradeoff between pull down or recovery time and efficiency where, for example, all present TECs are activated and are operated at a point between $Q_{COPmax}$ and $Q_{max}$. It is to be recognized that control of TECs is not limited to the foregoing illustrative examples.

In certain embodiments, the controller 106 includes a hardware processor and associated memory, such as may be arranged to store instructions that allow the hardware processor to perform various control operations as described herein.

As noted above, FIG. 1 illustrates the cooling capacity and cooling efficiency of a single TEC. Increasing the number of TECs linearly increases the heat removal capacity without affecting the operating COP of a thermoelectric cooling (e.g., refrigeration) system employing multiple TECs. Thus, if a thermoelectric cooling system includes four TECs, then the heat removal capacity of the thermoelectric cooling system would be is increased fourfold in comparison to an embodiment of a thermoelectric cooling system that includes a single TEC while allowing the entire system to, in some preferred embodiments, operate at any of various states between off (where input current=0), $Q_{COPmax}$ (where input current=$I_{COPmax}$), and $Q_{max}$ (where input current=$I_{max}$).

Figure 2:
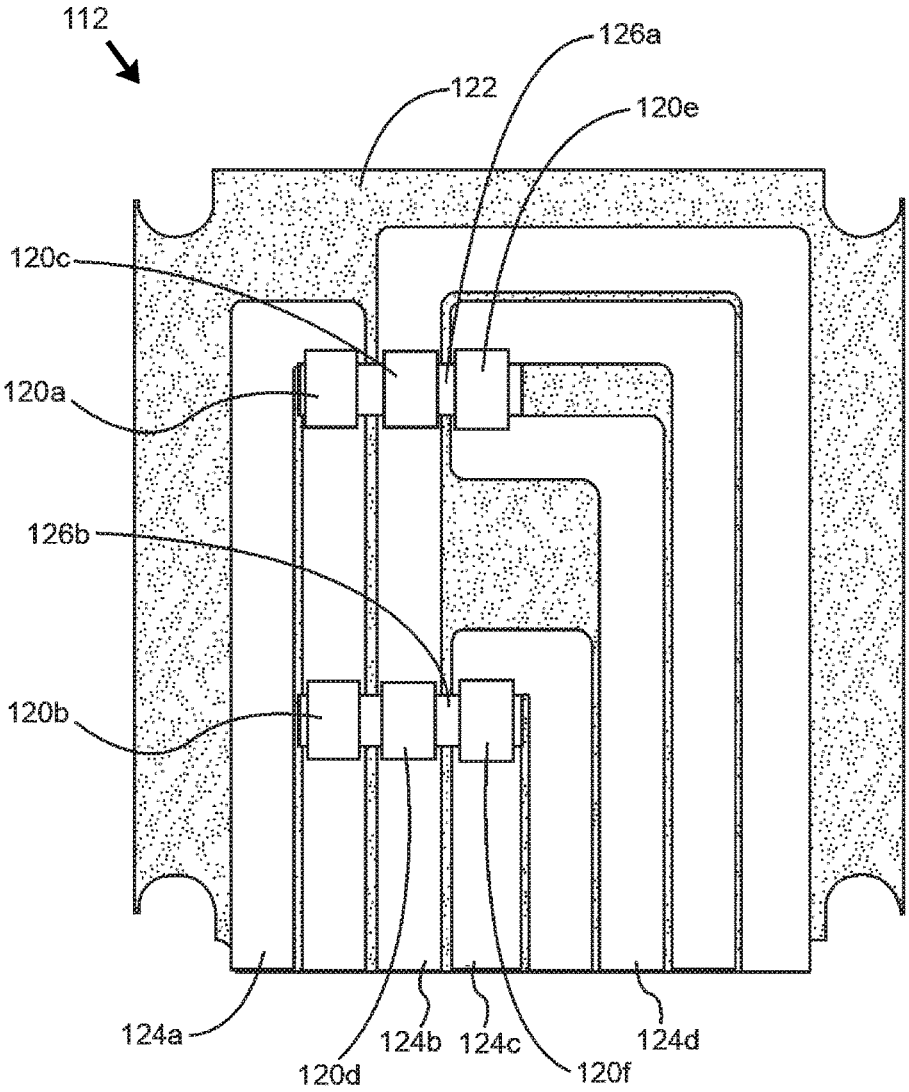
FIG. 2 illustrates a thermoelectric cartridge including multiple TECs arranged on an interconnect board that enables selective control of different subsets of the TECs.

Before discussing details and operation of a thermoelectric cooling system, it is beneficial to discuss a multi-TEC cartridge enabling separate and selective control of TECs. A representative multi-TEC cartridge 112 is illustrated in FIG. 2. The cartridge 112 utilizes multiple TECs 120*a*-120*f*. The use of multiple smaller capacity TECs is beneficial relative to the use of a single large capacity TEC because multiple TECs can be separately controlled to provide the desired performance under varying conditions. In contrast, a single over-sized TEC designed to provide a maximum desired capacity for pull down or recovery would not provide the flexibility of operating one or more TECs at or close to a maximum efficiency value ($Q_{COPmax}$). In other words, an over-sized TEC designed to operate efficiently at maximum capacity would not be capable of operating efficiently at low capacity, whereas one or more multiple smaller TECs can be activated by a controller and operated at (or close to) a maximum efficiency value over a wide range of operating conditions including steady state conditions. Any one or more TECs 120*a*-120*f* or the entire cartridge 112 incorporating the TECs 120*a*-120*b*, may also be referred to as a thermoelectric heat pump.

The cartridge 112 illustrated in FIG. 2 is merely one example of a multi-TEC cartridge permitting separate and selective control of different subsets of TECs according to a desired control scheme. In general, a multi-TEC cartridge may be configured to hold any number of TECs and to allow any number of subsets of the TECs to be separately controlled, with each subset generally including one or more TECs. Further, different subsets may include the same number or different numbers of TECs. Additional details regarding multi-TEC cartridges are disclosed in U.S. Patent Application Publication No. 2013/0291555 A1, entitled THERMOELECTRIC REFRIGERATION SYSTEM CONTROL SCHEME FOR HIGH EFFICIENCY PERFORMANCE, which is hereby incorporated by reference herein in its entirety.

As illustrated in FIG. 2, the cartridge 112 includes TECs 120*a*-120*f* (more generally referred to herein collectively as TECs 120 and individually as TEC 120) disposed on an interconnect board 122. The TECs 120 are thin film devices. Some non-limiting examples of thin film TECs are disclosed in U.S. Pat. No. 8,216,871, entitled METHOD FOR THIN FILM THERMOELECTRIC MODULE FABRICATION, which is hereby incorporated by reference herein in its entirety. The interconnect board 122 includes electrically conductive traces 124*a*-124*d* (more generally referred to herein collectively as traces 124 and individually as trace 124) that define four subsets of TECs 120*a*-120*f*. In particular, TECs 120*a*-120*b* are electrically connected in series with one another via the trace 124*a* and form a first subset of the TECs 120. Likewise, the TECs 120*c*-120*d* are electrically connected in series with one another via the trace 124*b* and form a second subset of the TECs 120. TEC 120*e* is connected to trace 124*d* and forms a third subset of the TECs 120, while TEC 120*f* is connected to trace 124*c* and forms a fourth subset of the TECs 120. A controller such as described herein can selectively control the first subset of TECs 120 (i.e., TECs 120*a* and 120*b*) by controlling a current applied to trace 124*a*, can selectively control the second subset of TECs 120 (i.e., TECs 120*c* and 120*d*) by controlling a current applied to trace 124*b*, can selectively control the third subset of TECs 120 (i.e., TEC 120*e*) by controlling a current applied to trace 124*d*, and can selectively control the fourth subset of TECs 120 (i.e., TEC 120*f*) by controlling a current applied to trace 124*c*. Thus, using TECs 120*a* and 120*b* as an example, a controller can selectively activate/deactivate TECs 120*a* and 120*b* by either removing current from the trace 124*a* (deactivate) or by applying a current to the trace 124*a* (activate), selectively increase or decrease the current applied to the trace 124*a* while the TECs 120*a* and 120*b* are activated, and/or control the current applied to the trace 124*a* in such a manner as to control a duty cycle of the TECs 120*a* and 120*b* following activation (e.g., by pulse width modulation of the current).

The interconnect board 122 includes openings 126*a* and 126*b* (more generally referred to herein collectively as openings 126 and individually as opening 126) that expose bottom surfaces of TECs 120*a*-120*f*. When the cartridge 112 is disposed between a hot side (reject) heat exchanger and a cold side (accept) heat exchanger (such as shown in FIG. 3), the openings 126*a* and 126*b* enable faces of the TECs 120*a*-120*f* to be thermally coupled to the appropriate heat exchanger.

In accordance with embodiments of the present disclosure, during operation, a controller as described herein can selectively activate or deactivate any combination of the subsets of the TECs 120 by applying or removing current from the corresponding traces 124*a*-124*d*. Further, a controller can control operating points of active TECs 120 by controlling the amount (or duty cycle) of current provided to the corresponding traces 124*a*-124*d*. For example, if only the first subset of the TECs 120 is to be activated and operated at $Q_{COPmax}$ during steady state operation, then a controller may provide current at a value of $I_{COPmax}$ to the trace 124*a* to thereby activate the TECs 120*a* and 120*b* and operate the TECs 120*a* and 120*b* at $Q_{COPmax}$, while removing current from the other traces 124*b*-124*d* to thereby deactivate the other TECs 120*c*-120*f*.

Figure 3:
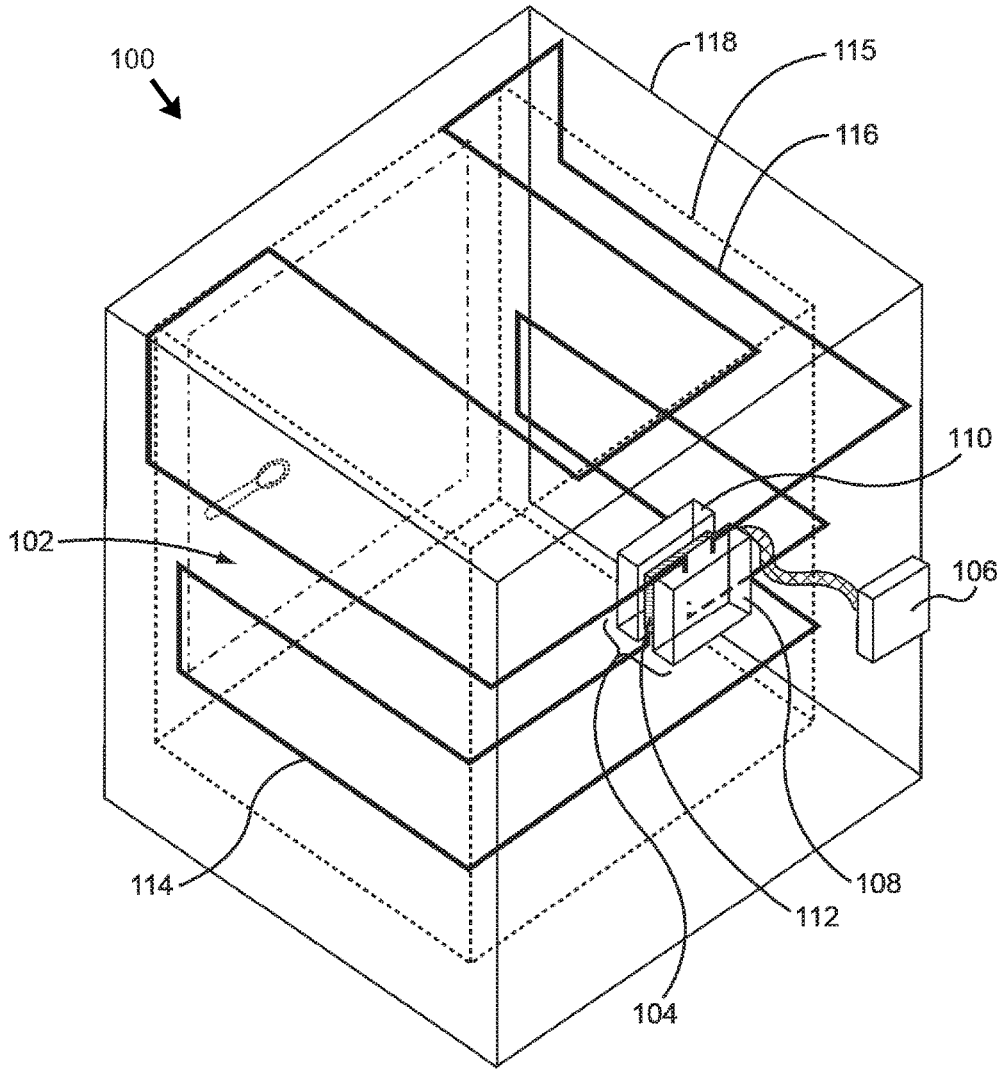
FIG. 3 is a perspective schematic view of a thermoelectric refrigeration system including a cooling chamber, a heat exchanger including a cartridge (such as the cartridge of FIG. 2) that includes multiple TECs disposed between a cold side heat sink and a hot side heat sink, and a controller that controls the TECs to maintain a set point temperature within the cooling chamber.

FIG. 3 illustrates a thermoelectric refrigeration system 100 to aid understanding of embodiments of the disclosure. As illustrated, the thermoelectric refrigeration system 100 includes a cooling chamber 102, a heat exchanger 104, and a controller 106 that controls cooling within the cooling chamber 102. The heat exchanger 104 includes a hot side heat exchange element 108, a cold side heat exchange element 110, and a cartridge 112 including multiple TECs (which may correspond to the cartridge 112 and TECs 120 illustrated in FIG. 2), wherein each TEC has a cold side that is thermally coupled with the cold side (accept) heat exchange element 110 and a hot side that that is thermally coupled with the hot side (reject) heat exchange element 108. Such TECs are preferably thin film devices. When one or more TECs are activated by the controller 106, the activated TEC(s) operate to heat the hot side heat exchange element 108 and cool the cold side heat exchange element 110 to thereby facilitate heat transfer to extract heat from the cooling chamber 102. More specifically, when one or more of TECs are activated, the hot side heat exchange element 108 is heated to thereby create an evaporator and the cold side heat exchange element 110 is cooled to thereby create a condenser.

Acting as a condenser, the cold side heat exchange element 110 facilitates heat extraction from the cooling chamber 102 via an accept loop 114 coupled with the cold side heat exchange element 110. The accept loop 114 is thermally coupled to an interior wall 115 of the thermoelectric refrigeration system 100. The interior wall 115 defines the cooling chamber 102. In one embodiment, the accept loop 114 is either integrated into the interior wall 115 or integrated directly onto the surface of the interior wall 115. The accept loop 114 is formed by any type of plumbing that allows for a cooling medium (e.g., a two-phase coolant) to flow or pass through the accept loop 114. Due to the thermal coupling of the accept loop 114 and the interior wall 115, the cooling medium extracts heat from the cooling chamber 102 as the cooling medium flows through the accept loop 114. The accept loop 114 may be formed of, for example, copper tubing, plastic tubing, stainless steel tubing, aluminum tubing, or the like.

The condenser formed by the cold side heat exchange element 110 and the accept loop 114 operates according to any suitable heat exchange technique. In one preferred embodiment, the accept loop 114 operates in accordance with thermosiphon principles (i.e., acts as a thermosiphon) such that the cooling medium travels from the cold side heat exchange element 110 through the accept loop 114 and back to the cold side heat exchange element 110 to thereby cool the cooling chamber 102 using two-phase, passive heat transport. (As an alternative, the accept loop 114 may be replaced with a heatpipe including a wicking medium whereby capillary forces in the wick ensure return of liquid from the hot end to the cold, as opposed to a thermosiphon which is gravity driven without requiring a wicking medium.) In particular, passive heat exchange occurs through natural convection between the cooling medium in the accept loop 114 and the cooling chamber 102. In one embodiment, the cooling medium is in liquid form when the cooling medium comes into thermal contact with the cooling chamber 102. Specifically, passive heat exchange occurs between the environment in the cooling chamber 102 and the cooling medium within the accept loop 114, such that the temperature in the cooling chamber 102 decreases and the temperature of the cooling medium increases and/or undergoes a phase change. When the temperature of the cooling medium increases, the density of the cooling medium decreases, such as through evaporation. As a result, the cooling medium moves in an upward direction via buoyancy forces in the accept loop 114 towards the heat exchanger 104 and specifically towards the cold side heat exchange element 110. The cooling medium comes into thermal contact with the cold side heat exchange element 110, where heat exchange occurs between the cooling medium and the cold side heat exchange element 110. When heat exchange occurs between the cooling medium and the cold side heat exchange element 110, the cooling medium condenses and again flows through the accept loop 114 via gravity in order to extract additional heat from the cooling chamber 102. Thus, in some embodiments, the accept loop 114 functions as an evaporator when cooling the cooling chamber 102.

As noted above, the heat exchanger 104 includes the cartridge 112 disposed between the hot side heat exchange element 108 and the cold side heat exchange element 110. The TECs in the cartridge 112 have hot sides (i.e., sides that are hot during operation of the TECs) that are thermally coupled with the hot side heat exchange element 108 and cold sides (i.e., sides that are cold during operation of the TECs) that are thermally coupled with the cold side heat exchange element 110. The TECs within the cartridge 112 effectively facilitate heat transfer between the cold side heat exchange element 110 and the hot side heat exchange element 108. More specifically, when heat transfer occurs between the cooling medium in the accept loop 114 and the cold side heat exchange element 110, the active TECs transfer heat between the cold side heat exchange element 110 and the hot side heat exchange element 108.

Acting as an evaporator, the hot side heat exchange element 108 facilitates rejection of heat to an environment external to the cooling chamber 102 via a reject loop 116 coupled to the hot side heat exchange element 108. The reject loop 116 is thermally coupled to an outer wall 118, or outer skin, of the thermoelectric refrigeration system 100. The outer wall 118 is in direct thermal contact with the environment external to the cooling chamber 102. Further, the outer wall 118 is thermally isolated from the accept loop 114 and the interior wall 115 (and thus the cooling chamber 102) by, for example, appropriate insulation. In one embodiment, the reject loop 116 is integrated into the outer wall 118 or integrated onto the surface of the outer wall 118. The reject loop 116 is formed of any type of plumbing that allows a heat transfer medium (e.g., a two-phase coolant) to flow or pass through the reject loop 116. Due to the thermal coupling of the reject loop 116 and the external environment, the heat transfer medium rejects heat to the external environment as the heat transfer medium flows through the reject loop 116. The reject loop 116 may be formed of, for example, copper tubing, plastic tubing, stainless steel tubing, aluminum tubing, or the like.

The evaporator formed by the hot side heat exchange element 108 and the reject loop 116 operates according to any suitable heat exchange technique. In one preferred embodiment, the reject loop 116 operates in accordance with thermosiphon principles (i.e., acts as a thermosiphon) such that the heat transfer medium travels from the hot side heat exchange element 108 through the reject loop 116 and back to the hot side heat exchange element 108 to thereby reject heat using two-phase, passive heat transport. In particular, the hot side heat exchange element 108 transfers heat received from the cold side heat exchange element 110 to the heat transfer medium within the reject loop 116. (Alternatively, the reject loop 116 may be replaced with a heatpipe.) Once heat is transferred to the heat transfer medium, the heat transfer medium changes phase and travels through the reject loop 116 and comes into thermal contact with the outer wall 118 such that heat is expelled to an environment (e.g., an ambient environment) external to the cooling chamber 102. When the heat transfer medium within the reject loop 116 is in direct thermal contact with the outer wall 118, passive heat exchange occurs between the heat transfer medium in the reject loop 116 and the ambient environment. As is well known, the passive heat exchange causes condensation of the heat transfer medium within the reject loop 116, such that the heat transfer medium travels back to the heat exchanger 104 by force of gravity. Thus, the reject loop 116 functions as a condenser when rejecting heat to the environment external to the cooling chamber 102.

In certain embodiments, the heat exchanger 104 is not in direct thermal contact with the cooling chamber 102 and is instead thermally isolated from the cooling chamber 102. Likewise, the heat exchanger 104 is not in direct thermal contact with the outer wall 118 and is instead thermally isolated from the outer wall 118. Accordingly, as will be detailed below, the heat exchanger 104 is thermally isolated from both the cooling chamber 102 and the outer wall 118 of the thermoelectric refrigeration system 100. Importantly, this provides a thermal diode effect by which heat is prevented from leaking back into the cooling chamber 102 when the TECs are deactivated.

The controller 106 operates to control TECs within the cartridge 112 in order to maintain a desired set point temperature within the cooling chamber 102. In general, the controller 106 operates to selectively activate/deactivate the TECs, selectively control an input current of the TECs, and/or selectively control a duty cycle of the TECs to maintain the desired set point temperature. Further, in preferred embodiments, the controller 106 is enabled to separately, or independently, control one or more and, in some embodiments, two or more subsets of the TECs, where each subset includes one or more different TECs. Thus, as an example, if there are four TECs in the cartridge 112, the controller 106 may be enabled to separately control a first individual TEC, a second individual TEC, and a group of two TECs (i.e., a first and a second individual TEC and a group of two TECs). By this method, the controller 106 can, for example, selectively activate one, two, three, or four TECs independently, at maximized efficiency, as demand dictates.

Continuing this example, the controller 106 may be enabled to separately and selectively control: (1) activation/deactivation of the first individual TEC, an input current of the first individual TEC, and/or a duty cycle of the first individual TEC; (2) activation/deactivation of the second individual TEC, an input current of the second individual TEC, and/or a duty cycle of the second individual TEC; and (3) activation/deactivation of the group of two TECs, an input current of the group of two TECs, and/or a duty cycle of the group of two TECs. Using this separate selective control of the different subsets of the TECs, the controller 106 preferably controls the TECs to enhance efficiency of the thermoelectric refrigeration system 100. For example, the controller 106 may control the TECs to maximize efficiency when operating in a steady state mode, such as when the cooling chamber 102 is at the set point temperature or within a predefined steady state temperature range. However, during pull down or recovery, the controller 106 may control the TECs to achieve a desired performance such as, for example, maximizing heat extraction from the cooling chamber 102, providing a tradeoff between pull down/recovery times and efficiency, or the like.

While the preceding discussion of FIGS. 2 and 3 describe embodiments enabling selective control of different TECs on a single cartridge 112, it is to be recognized that similar principles may be used to control multiple TECs that may be disposed on separate cartridges (e.g., each having one or more TECs) or other substrates, which may be arranged between paired surfaces of one or more heat exchanger assemblies (e.g., between a first cold (accept) side heat exchanger paired with a first hot (reject) side heat exchanger, or between first and second cold (accept) side heat exchangers paired with respective first and second hot (reject) side heat exchangers).

As noted previously, the thermoelectric refrigeration system 100 described in connection with FIG. 3 may utilize a passive heat accept subsystem and a passive heat reject system, which may each include a thermosiphon or a heatpipe. Such passive subsystems are beneficially devoid of moving parts and therefore are highly reliable, and also may operate silently. Passive heat accept and passive heat reject subsystems, however, can suffer from lack of available surface area during periods of high heat loading (e.g., transient conditions), and passive heat reject subsystems can suffer from lack of available surface area during high temperature reject conditions—but such subsystems can provide perfectly adequate heat transfer utility during steady state conditions.

To overcome limitations of passive heat accept and/or passive heat reject subsystems which may be used for cooling chambers or surfaces, such subsystems may be augmented with at least one selectively operable forced convection stage according to certain embodiments of the present disclosure. In certain embodiments, a forced convection unit may include one or more fans, blowers, eductors, or other draft inducing elements. Although certain embodiments disclosed herein refer to use of fans, it is to be appreciated that a fan represents merely one type of forced convection unit, and any suitable types of forced convection unit may be employed, whether in lieu of or including fans. By utilizing at least one forced convection unit that is only energized during high heat loading conditions and/or high temperature heat reject conditions, heat accept and/or heat reject subsystems can provide sufficient capacity to allow for transient high heat load handling capability, while maintaining benefits of fully passive heat transport during normal (e.g., steady state) operating conditions.

In certain embodiments, a forced convection boost stage may be used to augment a passive single phase reject system or accept system which may be used to cool a chamber or surface. In certain embodiments, a forced convection boost stage may be used to augment a passive two-phase reject system or accept system which may be used to cool a chamber or surface. In certain embodiments, at least one forced convection unit may be arranged proximate to at least one heat exchanger at the accept side and/or at the reject side of a heat transport system.

In certain embodiments, at least one forced convection unit is operated during periods of high heat loading (e.g., transient conditions such as pull down or recovery) and/or high temperature reject conditions, but not operated during normal conditions (e.g., involving steady state heat load and typical ambient environment conditions) when the passive heat transport subsystem(s) are preferably sufficient for heat to be accepted from the surface or chamber to be cooled and/or for heat to be rejected to an ambient environment. During initial cool-down, in elevated ambient conditions, or in response to abnormal internal loading, at least one forced convection unit may be energized to assist a primary passive transport system to remove or mitigate the abnormal condition. During normal operation in standard environmental conditions, the forced convection unit(s) would be fully un-energized, thereby allowing for fully passive operation and avoiding power consumption and noise inherent to operation of the forced convection unit(s). Thus, in preferred embodiments, a primary passive heat transport subsystem is preferably sufficient to handle operational loading in all conditions, whereas one or more forced convection units are selectively operable as a secondary subsystem to provide a performance boost when desired, but the forced convection unit(s) are not required for basic system performance and therefore would not affect overall system reliability.

While interior and exterior forced convection units are described herein, certain embodiments may utilize only interior forced convection or only exterior forced convection. In certain embodiments, multiple interior forced convection units and/or multiple exterior forced convection units may be provided. In certain embodiments, multiple interior fans and/or multiple exterior fans may be provided, and may be independently controllable to permit similarly situated fans to be sequentially operated or operated together as necessary to meet thermal demand or other requirements. In certain embodiments, one or more forced convection units may be controlled with a multi-stage or variable speed controller in order to permit convective flow to be varied depending on demand and/or power or noise limitations.

In certain embodiments, a controller receives temperature data indicative of at least one of (i) temperature of an ambient environment containing the heat transport system, and (ii) temperature of a chamber or surface to be cooled. The controller activates at least one forced convection unit upon detection of a condition indicative of at least one of the following states: temperature of the chamber or surface exceeds a steady state temperature range that includes the set point temperature or set point temperature range, and temperature of an ambient environment exceeds an ambient environment threshold temperature or ambient environment threshold temperature range. The controller deactivates at least one forced convection unit upon detection of a condition indicative of at least one of the following states: temperature of the chamber or surface is within the steady state temperature range, and/or temperature of an ambient environment is below the ambient environment threshold temperature or ambient environment threshold temperature range.

Figure 4:
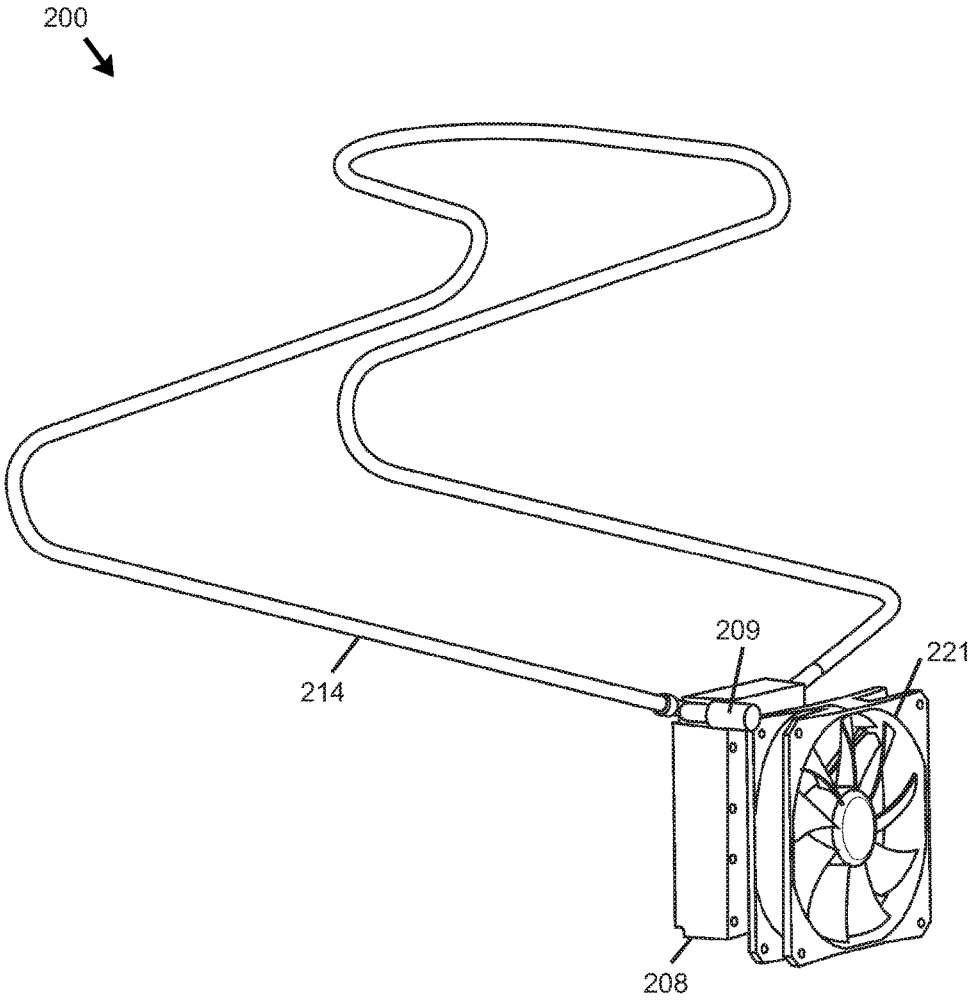
FIG. 4 is a perspective view of at least a portion of a heat transport system including a selectively operable forced convection unit arranged to enhance cooling of a heat exchanger in thermal communication with a fluid-containing loop according to one embodiment of the present disclosure.

FIG. 4 is a perspective view of at least a portion of a heat transport system 200 including a forced convection unit (e.g., a fan) 221 arranged to enhance cooling of heat exchanger 208 in thermal communication with a fluid-containing conduit or loop 214 according to one embodiment of the present disclosure. The heat transport system 200 may preferably be used as part of a thermoelectric cooling system, but is not limited to use with thermoelectric cooling elements. The fluid-containing conduit or loop 214 is preferably arranged for passive movement of a heat transfer fluid, and may embody a thermosiphon or a heat-pipe. A fitting 209 may be provided in fluid communication with the fluid-containing conduit or loop 214 to permit addition of heat transfer fluid. The heat transport system 200 may be arranged in thermal communication with at least one surface or chamber (not shown) to be cooled, such as by placing a portion of the fluid-containing conduit or loop 214, or by placing a surface of the heat exchanger 208, in thermal communication with the surface or chamber to be cooled. In certain embodiments, the heat exchanger 208 may be arranged in conductive thermal communication with at least one TEC or thermoelectric cartridge (not shown) as described previously herein. In certain embodiments, the fluid-containing conduit or loop 214 and the heat exchanger 208 may be utilized on the accept (cold) side of a refrigeration or cooling system. In certain embodiments, the fluid-containing conduit or loop 214 and the heat exchanger 208 may be utilized on the reject (hot) side of a refrigeration or cooling system, with the heat exchanger 208 serving as a heat sink to dissipate heat to an ambient environment. In preferred embodiments, the forced convection unit 221 is selectively operable to be operated only during high heat-loading conditions and/or high temperature heat reject conditions, and the forced convection unit 221 is de-energized during steady state and/or normal ambient conditions, when the fluid-containing conduit or loop 214 and heat exchanger 208 are operated passively without need for enhanced heat transport via forced convection. In less preferred embodiments, flow of fluid within the fluid-containing conduit or loop 214 may be motivated by or augmented with a pump or other fluid pressurization element (not shown).

Figure 5:
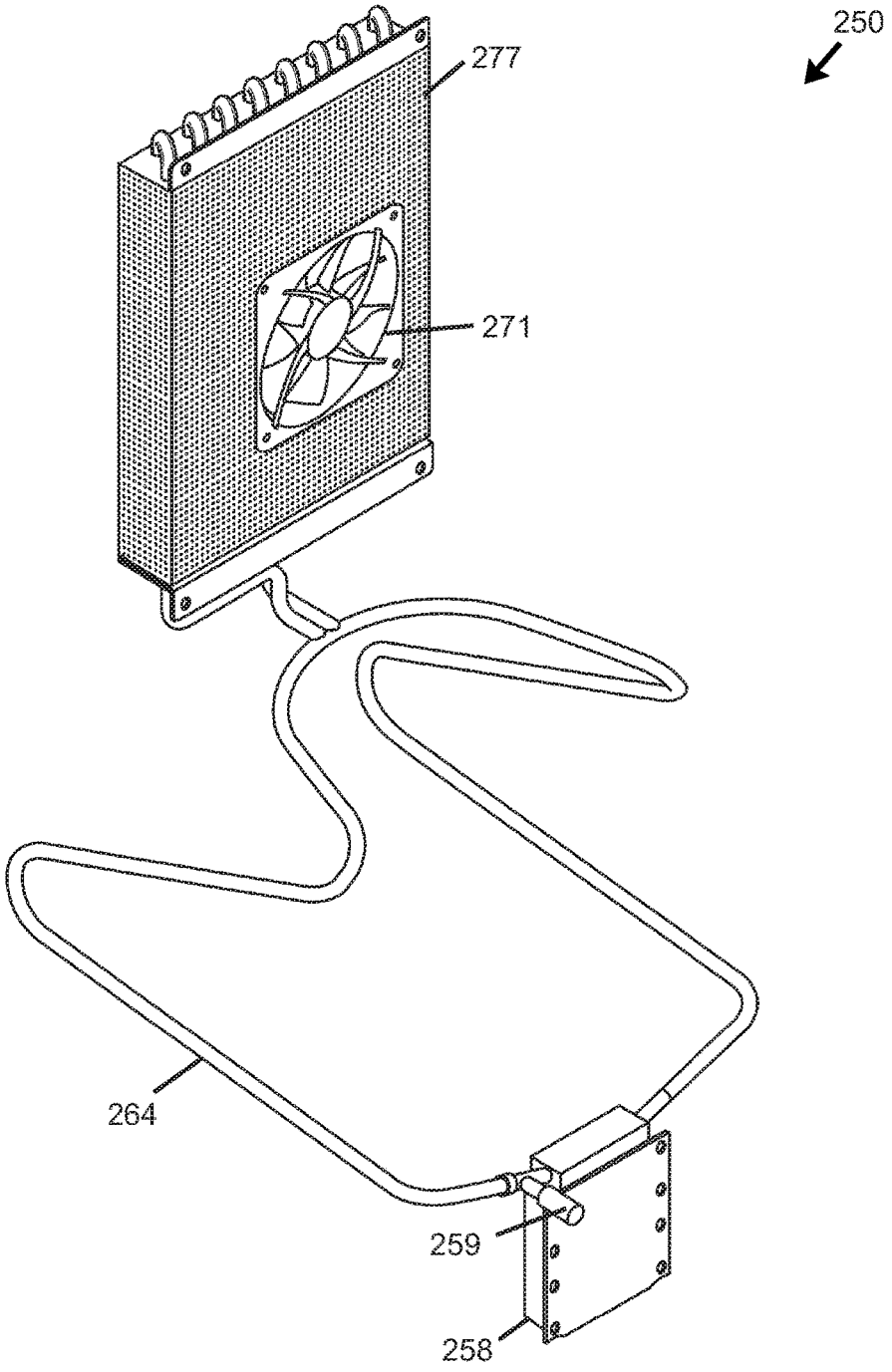
FIG. 5 is a perspective view of at least a portion of a heat transport system including a selectively operable forced convection unit arranged to enhance cooling of a fluid-containing finned heat sink in thermal communication with a heat exchanger according to one embodiment of the present disclosure.

FIG. 5 is a perspective view of at least a portion of a heat transport system 250 including a selectively operable forced convection unit 271 arranged to enhance cooling of a fluid-containing finned heat sink 277 in thermal communication with a heat exchanger 258 by way of a fluid-containing conduit or loop 264 according to one embodiment of the present disclosure. The heat transport system 250 may preferably be used as part of a thermoelectric cooling system, but is not limited to use with thermoelectric cooling elements. The fluid-containing conduit or loop 264 is preferably arranged for passive movement of a heat transfer fluid, and may embody a thermosiphon or a heat-pipe. A fitting 259 may be provided in fluid communication with the fluid-containing conduit or loop 264 to permit addition of heat transfer fluid. The heat transport system 250 may be arranged in thermal communication with at least one surface or chamber (not shown) to be cooled, such as by placing a portion of the fluid-containing conduit or loop 264, or by placing a surface of the heat exchanger 258, in thermal communication with the surface or chamber to be cooled. In certain embodiments, the heat exchanger 258 may be arranged in conductive thermal communication with at least one TEC or thermoelectric cartridge (not shown) as described previously herein. In certain embodiments, the fluid-containing conduit or loop 264 and the heat exchanger 258 may be utilized on the accept (cold) side of a refrigeration or cooling system. In certain embodiments, the fluid-containing conduit or loop 264 and the heat exchanger 258 may be utilized on the reject (hot) side of a refrigeration or cooling system, with the fluid-containing finned heat sink 277 serving to dissipate heat to an ambient environment. In preferred embodiments, the forced convection unit 271 is selectively operable to be operated only during high heat-loading conditions and/or high temperature heat reject conditions, and the forced convection unit 271 is de-energized during steady state and/or normal ambient conditions, when the fluid-containing conduit or loop 264, heat exchanger 258, and finned heat sink 277 are operated passively without need for enhanced heat transport via forced convection. In less preferred embodiments, flow of fluid within a fluid-containing loop 264 may be motivated by or augmented with a pump or other fluid pressurization element (not shown).

FIG. 6 illustrates a thermoelectric cooling or refrigeration system 300 according to one embodiment of the present disclosure. The cooling or refrigeration system 300 includes a cooling chamber 302 that is bounded by an interior wall 303, which is surrounded by an outer wall 301 or outer skin. Thermal insulation (not shown) is preferably provided between the interior wall 303 and the outer wall 301. A primary accept loop or conduit 308 is arranged in thermal communication with the cooling chamber 302, such as by being in contact with the interior wall 303 or integrated directly onto a surface of the interior wall 303. A secondary accept loop or conduit 309 may optionally include at least one accept side heat exchanger 307 (which may include fins 305) arranged to receive air from an interior forced convection unit 311 disposed within the cooling chamber 302. The interior forced convection unit 311 may be selectively operated to enhance transfer of heat from the cooling chamber 302 to the secondary accept loop or conduit 309, such as may be desirable during pull down or recovery, but the interior forced convection unit 311 may be de-energized during steady state conditions. The interior forced convection unit 311 may alternatively (or additionally) be operated to reduce stratification of temperature within the cooling chamber 302, such as may be detected by multiple temperature sensors (not shown) in thermal communication with the cooling chamber 302 or the interior wall 303. The accept loops or conduits 308, 309 are arranged in contact with a cold (accept) side heat exchanger 310.

Continuing to refer to FIG. 6, a thermoelectric heat exchange assembly includes the cold (accept) side heat exchanger 310, at least one thermoelectric cartridge 312 incorporating TECs, and a hot (reject) side heat exchanger 314. The hot (reject) side heat exchanger 314 is in thermal communication with fluid-containing conduits or loops 316A, 316C (each preferably arranged for passive movement of a heat transfer fluid, and as may be embodied in thermosiphons or heatpipes) arranged to dissipate heat to a hot (reject) side heat sink 315 including multiple arrays of fins 317A, 317B. Within the hot (reject) side heat sink 315, a first fluid-containing loop or conduit 316A is in conductive thermal communication with a first array of fins 317A, and a second fluid-containing loop or conduit 316B is in conductive thermal communication with a second array of fins 317B. At least one exterior forced convection unit 321 is arranged to enhance dissipation of heat from the hot (reject) side heat sink 315. The exterior forced convection unit 321 may be selectively operated to enhance transfer of heat from the hot (reject) side heat sink 315 to an ambient environment, such as may be desirable during pull down or recovery and/or abnormally high reject temperature conditions, but the exterior forced convection unit 321 may be de-energized during steady state conditions. The thermoelectric cartridge 312 and the forced convection units 311, 321 are controlled by a controller 306 associated with the thermoelectric cooling or refrigeration system 300. Although FIG. 6 illustrates a single thermoelectric heat exchange assembly (e.g., including a cold (accept) side heat exchanger 310, at least one thermoelectric cartridge 312 incorporating TECs, and a hot (reject) side heat exchanger 314), a single hot (reject) side heat sink 315, a single interior forced convection unit 311, and a single exterior forced convection unit 321, it is to be appreciated that two or more of the foregoing assemblies or components may be provided in certain embodiments, such as to provide increased cooling capacity, separate control of different cooling chambers or zones (or portions) thereof, and/or to enhance reliability.

FIG. 7 is a schematic diagram illustrating interconnections between power, sensory, control, and user interface components of a thermoelectric cooling or refrigeration system such as the system 300 of FIG. 6 according to one embodiment of the present disclosure. In addition to the controller 306 and thermoelectric cartridge 312 shown in FIG. 6, FIG. 7 illustrates that a thermoelectric cooling or refrigeration system may include a user interface 376, a power source 378, an accessory (ACC) 380, power electronics 382, temperature sensors 354-356, and fans (or other forced convection units) 311, 321. The user interface 376 allows a user to input various control parameters associated with the thermoelectric cooling or refrigeration system 300, including at least one set point temperature of the cooling chamber 302. In certain embodiments, input control parameters may additionally include values for a steady state range of temperatures. In certain embodiments, the user interface 376 may additionally allow the user or a manufacturer of the thermoelectric refrigeration system to define a maximum allowable temperature for the hot (reject) side heat exchanger 314, current values associated with $I_{COPmax}$ and $I_{max}$, and/or other parameters. In certain embodiments, some or all control parameters may be programmed or hard-coded into the controller 306.

The power source 378 provides electric power to the controller 306, the accessory 380, and the power electronics 382. The accessory 380 may include a chamber light and/or a communication module for expanded capabilities. In an embodiment where the accessory 380 is a communication module, the accessory 380 may communicate with remote devices, such as, but not limited to: a cellular telephone, a remotely located computing device, or even other appliances and thermoelectric cooling or refrigeration systems. In an embodiment where the accessory 380 communicates with a cellular telephone or a remotely located computing device, the accessory 380 can provide operational parameters (e.g., temperature data) of the thermoelectric cooling or refrigeration system 300 and the cooling chamber 302 to a remote device or entity. In an embodiment where the accessory 380 communicates with other thermoelectric refrigeration systems, the accessory 380 may communicate operational parameters of the thermoelectric cooling or refrigeration system 300 to the other thermoelectric refrigeration systems, such as the set point temperature, upper and lower thresholds of the set point temperature, a maximum allowable temperature of the cooling chamber 302, the maximum allowable temperature of the hot (reject) side heat exchanger 314, or the like.

The power electronics 382 generally operate to provide current to the thermoelectric cartridge 312 and TECs 320 in response to control signals from the controller 306. In certain embodiments, the power electronics 382 may independently provide current to different subsets of the TECs 320. In certain embodiments, duty cycles of different subsets of the TECs 320 are also controlled. In this case, the power electronics 382 may provide a pulse width modulation function by which duty cycles of the different subsets of the TECs 320 may be controlled.

As shown in FIG. 7, the controller 306 is arranged to receive temperature data from temperature sensors 354-356, wherein the temperature data may include one or more of the following: temperature ($T_{CH}$) of the cooling chamber 302 sensed by a first temperature sensor 354, temperature of an ambient environment ($T_{Amb}$) sensed by a second temperature sensor 355, and temperature ($T_R$) of the hot (reject) side heat exchanger 314 (or of the hot (reject) side heat sink 315) sensed by a third temperature sensor 356. Based on the temperature data, the controller 306 determines a current mode of operation of the thermoelectric cooling or refrigeration system 300. As illustrated in FIG. 7, potential modes of operation according to certain embodiments include a pull down mode 358, a steady state mode 360, an over temperature mode 362, and a recovery mode 363. The pull down mode 358 generally occurs when the thermoelectric cooling or refrigeration system 300 is first powered on and it is necessary to reduce (or 'pull down') temperature within the cooling chamber 302. The steady state mode 360 occurs when the temperature of the cooling chamber 302 is at or near the desired set point temperature. In particular, the temperature of the cooling chamber 302 is at or near the desired set point temperature when the temperature of the cooling chamber 302 is within a predefined steady state range that includes the set point temperature (e.g., the set point temperature of the cooling chamber 302 ±2 degrees). An over temperature mode 362 may be detected when the temperature on the hot (reject) side heat exchanger 314 is above a predefined maximum allowable temperature, such as may occur when ambient temperature conditions exceed a normal range and/or when the cooling chamber 302 does not properly cool down (e.g., if a door to the cooling chamber 302 is not closed). The over temperature mode 362 is a safety mode during which the exterior fan(s) 321 are activated to enhance heat transfer from the hot (reject) side heat sink 315 to the ambient environment to seek to reduce temperature of the hot (reject) side heat exchanger 314 so as to reduce the hot side temperature of the TECs 320 in order to protect the TECs 320 from damage. If operation of the exterior fan(s) 321 is not sufficient to reduce temperature at the hot (reject) side heat exchanger 314 (and at the hot side of the TECs 320), then supply of current to the TECs may be limited in order to reduce heat input to the TECs 320 to prevent damage. Lastly, the recovery mode 363 is when the temperature of the cooling chamber 302 increases outside of the steady state range due to, for example, heat leak into the cooling chamber 302, opening of a door of the cooling chamber 302, or the like.

Operation of the controller 306 in the different modes 358, 360, 362, and 363 (as depicted in FIG. 7) according to certain embodiments of the present disclosure is illustrated in FIG. 8. When operating in the pull down mode 358, the controller 306 controls the currents to all of the TECs 320 associated with the at least one cartridge 312 such that all of the TECs 320 operate at a power level between $Q_{COPmax}$ and $Q_{max}$ (corresponding to a current between $I_{COPmax}$ and $I_{max}$) as the desired performance profile dictates, and one or both of the fans (or other forced convection units) 311, 321 are operated to enhance convective heat transfer. The controller 306 determines when the thermoelectric cooling or refrigeration system 300 is in the pull down mode 358 based on, for example, being initially powered on, such as when the thermoelectric cooling or refrigeration system 300 is first purchased or after the thermoelectric cooling or refrigeration system 300 is powered on after becoming disconnected from a power source. The controller 306 maintains all of the TECs 320 at a power level between $Q_{COPmax}$ and $Q_{max}$ and maintains the fans 311, 321 in operation until the temperature of the cooling chamber 302 is pulled down to the set point temperature or within an acceptable range of the set point temperature, as shown with reference to block 366. Once the cooling chamber 302 is pulled down to the set point temperature, the controller 306 deactivates the fans 311, 321 and controls operation of the TECs 320 such that all of the TECs 320 operate at $Q_{COPmax}$ by causing the current $I_{COPmax}$ to be provided to all operating TECs 320. The controller 306 may also reduce the number of TECs 320 that are active or subject to being activated once the cooling chamber 302 is pulled down to the set point temperature.

As noted above, based on the temperature data, the controller 306 determines when the thermoelectric cooling or refrigeration system 300 is in the steady state mode 360 (i.e., when the temperature of the cooling chamber 302 is equal to the set point temperature or within a predetermined range of the set point temperature). When in steady state mode 360, the controller 306 preferably deactivates any fans 311, 321 that may have been operating, and operates the required number of the TECs 320 at $Q_{COPmax}$ as dictated by demand. Under steady state conditions, passive heat transport is preferably sufficient for heat to be accepted from the surface or chamber to be cooled and/or for heat to be rejected to an ambient environment without need for forced convection by the fans 311, 321. In certain embodiments, all of the TECs 320 may be operated at $Q_{COPmax}$ in the steady state mode 360. During the steady state mode 360, if $Q_{COPmax} > Q_{leak}$ as shown with reference to block 367, then the temperature of the cooling chamber 302 will continue to decrease. In this case, the controller 306 may reduce the duty cycle of the activated TECs 320 as shown with reference to block 368. Conversely, if $Q_{COPmax}<Q_{leak}$ as shown with reference to block 369, then the temperature of the cooling chamber 302 will increase. In this case, the controller 306 may increase the number of active TECs 320 and adjust the current provided to the active TECs 320 to a value between $I_{COPmax}$ and $I_{max}$ as shown with reference to block 370. In this context, $Q_{leak}$ refers to the amount of heat leaking into the cooling chamber 302, such as heat passing through a seal of a door of the cooling chamber 302, heat conduction through walls surrounding cooling chamber 302, or the like.

As mentioned above, the controller 306 determines if the thermoelectric cooling or refrigeration system 300 is in the over temperature mode 362 based on temperature data from one or more of the second temperature sensor 355 (corresponding to $T_{Amb}$) and the third temperature sensor 356 (corresponding to ($T_R$). An over temperature mode 362 may be detected when the temperature on the hot (reject) side heat exchanger 314 is above a predefined maximum allowable temperature, such as may occur when ambient temperature conditions exceed a normal range and/or when the cooling chamber 302 does not properly cool down (e.g., if a door to the cooling chamber 302 is not closed). Referring to block 371, when over temperature mode 362 is detected, the exterior fan(s) 321 are activated to enhance heat transfer from the hot (reject) heat sink 315 to the ambient environment to seek to reduce temperature of the reject side of the hot (reject) side heat exchanger 314 in order to protect the TECs 320 from damage. Referring to block 372, if operation of the exterior fan(s) 321 is not sufficient to reduce temperature at the hot (reject) side heat exchanger 314 (and at the hot side of the TECs 320), then the controller 306 may decrease the temperature at the hot (reject) side heat exchanger 314 by deactivating or reducing current to some or all of the TECs 320 that are facilitating cooling or by reducing the current being provided to the TECs 320 in order to prevent damage. For example, if all of the TECs 320 are operating, either at $Q_{COPmax}$ or $Q_{max}$, then the controller 306 may deactivate one or more of the TECs 320 or preferably all of the TECs 320. In another example, if two subsets of TECs 320 are operating at $Q_{max}$, then the controller 306 may deactivate the one subset of TECs such that only the other subset of TECs 320 are operating at $Q_{max}$ and facilitating heat extraction from the cooling chamber 302. In another example, if one subset of TECs 320 are operating at $Q_{COPmax}$, the controller 306 may deactivate the active subset of TECs 320 and then activate a previously inactive set of TECs 320 in order to maintain the temperature of the cooling chamber 302 as close as to the set point temperature as possible without harming the thermoelectric cartridge 312. It should be noted that the controller 306 may deactivate any number of active TECs 320 and activate any number of the inactive TECs 320 in response to determining that the temperature of the hot (reject) side heat exchanger 314 exceeds the maximum allowable temperature.

As noted above, if the controller 306 determines that the temperature of the hot (reject) side heat exchanger 314 exceeds the predetermined maximum allowable temperature, the controller 306 may reduce the current being provided to some or all operating TECs 320 in addition to, or as an alternative to, deactivating some or all of the TECs 320. To further illustrate this functionality, if all of the TECs 320 are operating, either at $Q_{COPmax}$ or $Q_{max}$, the controller 306 may decrease the amount of current being provided to each of the TECs 320. For example, if all of the TECs 320 are operating at $Q_{max}$, the controller 306 may reduce the current from $I_{max}$ to a value that is between $I_{COPmax}$ and $I_{max}$. In addition, if all of the TECs 320 are operating at $Q_{COPmax}$ or $Q_{max}$, the controller 306 may only reduce the current provided to some of the TECs 320 in order to reduce the temperature of the hot (reject) side heat exchanger 314. In a further embodiment, the controller 306 may also deactivate some of the TECs 320 and simultaneously decrease the current to some or all of the TECs 320 that are still activated if the temperature of the hot (reject) side heat exchanger 314 exceeds the predetermined maximum allowable temperature.

When in the recovery mode 363, the controller 306 switches the active TECs 320 from operating at $Q_{COPmax}$ to operating at $Q_{max}$, and further activates the fans 311, 321 as shown at block 373. The recovery mode 363 occurs when, during steady state operation, the controller 306 receives temperature data from the temperature sensor 354 indicating that the temperature within the cooling chamber 302 has significantly increased above the set point temperature within a short period of time. Specifically, the thermoelectric cooling or refrigeration system 300 may enter the recovery mode 363 when the temperature within the cooling chamber 302 increases above an upper threshold of the steady state range of temperatures (e.g., increases above the set point temperature plus some predefined value that defines the upper threshold of the desired steady state range). Such operation is preferably maintained until steady state conditions are attained.

It should be noted that the control blocks 366-373 illustrated in FIG. 8 for the different modes 358, 360, 362, and 363 are mere examples. The manner in which the controller 306 controls the TECs 320 and fans 311, 321 in each of the modes 358, 360, 362, and 363 may vary depending on the particular implementation. In general, as discussed above, the controller 306 controls the TECs 320 to reduce the temperature of the cooling chamber 302 when in either the pull down mode 358 or the recovery mode 363, and the fans 311, 321 are activated. The exact manner in which these actions are taken may vary. For example, if the performance profile is that a minimum pull down or recovery time is desired, the controller 306 can activate all of the TECs 320 at $Q_{max}$ with a 100% duty cycle (always on) while the fans 311, 321 are active. Conversely, if a trade-off between pull down or recovery time and efficiency is desired, the controller 306 can, for example, activate all of the TECs 320 at $Q_{COPmax}$ with a 100% duty cycle (always on) or at anywhere in between $Q_{COPmax}$ and $Q_{max}$. In another example, speed of one or more fans 311, 321 may be adjusted stepwise or in a substantially continuous manner, or similarly fans 311, 321 may be sequentially operated according to signals received from the controller 306. Adjustment of operation of fans 311, 321 may be performed instead of or in addition to adjustment of operation of various TECs 320. When in the steady state mode 360, the controller 306 generally operates to maintain the set point temperature in an efficient manner. For example, the controller 306 can operate the required number of the TECs 320 (e.g., all of the TECs 320 or less than all of the TECs 320) at $Q_{COPmax}$ based on load. This predetermined number of the TECs 320 is a number of the TECs 320 that is required to maintain the set point temperature by operating at or near $Q_{COPmax}$. If not all of the TECs 320 are needed during the steady state mode 360, then the unneeded TECs 320 are deactivated. The controller 306 can fine tune the operation of the activated TECs 320 to precisely maintain the set point temperature by, for example, slightly increasing or decreasing the input current of the activated TECs 320 such that the activated TECs 320 operate slightly above $Q_{COPmax}$ or by increasing or decreasing the duty cycle of the activated TECs 320 to compensate for $Q_{leak}$.

In certain embodiments, one or more forced convection units (e.g., fans) of a thermoelectric refrigeration system as disclosed herein may be operated by a controller taking into account a set point temperature and a temperature of an ambient environment. Generally, when the ambient temperature rises and/or when a very low set point temperature is selected, operation of one or more forced convection units becomes more desirable to permit the desired set point to be maintained at a safe reject temperature (i.e., without overheating TECs). FIG. 9 is a horizontal bar graph illustrating one example of conditions under which a thermoelectric refrigeration system may be operated in fan assist mode (with forced convection) and in passive mode (without forced convection). Each horizontal bar illustrates a range of set point and ambient temperatures, wherein it is understood that the set point temperature should be less than the ambient temperature for proper operation of a thermoelectric refrigeration system. The lowermost two horizontal bars of FIG. 9 illustrate that when the ambient temperature is no greater than 21° C. or no greater than 25° C., and when the set point temperature is no less than 5° C., fan assist (i.e., forced convection) is not necessary, since a thermoelectric refrigeration system as disclosed herein can safely attain the desired set point temperature with passive heat rejection alone (e.g., using a thermosiphon or heatpipe in conjunction with an appropriate heat sink). As the ambient temperature rises, however, the situation changes. The third highest horizontal bar of FIG. 9 illustrates that fan assist (e.g., forced convection) is not necessary when the ambient temperature is no greater than 32° C. and when the set point temperature is no less than 12° C.; however, fan assist (forced convection) may be necessary when the set point temperature is in range of from 5° C. to 12° C. and the ambient temperature is no greater than 32° C. The uppermost horizontal bar of FIG. 9 further illustrates that fan assist (e.g., forced convection) is not necessary when the ambient temperature is no greater than 38° C. and when the set point temperature is no less than 18° C.; however, fan assist (forced convection) may be necessary when the set point temperature is in range of from 8° C. to 18° C. and the ambient temperature is no greater than 38° C. It is to be noted that FIG. 9 represents merely one representative example of conditions under which a thermoelectric refrigeration system may be operated in fan assist mode (with forced convection) and in passive mode (without forced convection); other conditions may be used to dictate when forced convection should be employed.

Consistent with the preceding discussion, in certain embodiments a heat transport system arranged to maintain a set point temperature or set point temperature range of a chamber or surface may include multiple elements, including: at least one heat exchanger; a fluid-containing conduit containing a heat transport fluid in thermal communication with the at least one heat exchanger; at least one forced convection unit that is selectively operable to enhance convective heat transfer relative to the at least one heat exchanger; and a controller. The controller may be arranged to: receive temperature data indicative of at least one of (i) temperature of an ambient environment containing the heat transport system, and (ii) temperature of the chamber or surface; activate the at least one forced convection unit upon detection of a condition indicative of at least one of the following states (a) and (b): (a) temperature of the chamber or surface exceeds a steady state temperature range that includes the set point temperature or set point temperature range, and (b) temperature of an ambient environment exceeds an ambient environment threshold temperature or ambient environment threshold temperature range; and deactivate the at least one forced convection unit upon detection of a condition indicative of at least one of the following states (I) and (II): (I) temperature of the chamber or surface is within the steady state temperature range, and (II) temperature of an ambient environment is below the ambient environment threshold temperature or ambient environment threshold temperature range. In certain embodiments, the at least one forced convection unit may include one or more fans, blowers, eductors, or other draft inducing elements, which may preferably be electrically operated.

Regarding the heat transport system of the preceding paragraph, in certain embodiments the at least one heat exchanger, the fluid conduit, and the heat transport fluid are arranged to maintain a set point temperature or set point temperature range of a chamber or surface without operation of the forced convection unit during steady state operation when the temperature of the ambient environment does not exceed the ambient environment threshold temperature or ambient environment threshold temperature range. In certain embodiments, the heat transport fluid may include a liquid phase and a gas phase within the fluid conduit, and the heat transport fluid is arranged for passive flow within the fluid conduit. In certain embodiments, the fluid conduit may include a thermosiphon or a heatpipe to facilitate passive flow of the fluid. In certain embodiments, the heat transport fluid may include a liquid, and the heat transport system may include a pump or other fluid pressurization element arranged to motivate or augment flow of heat transport fluid within the fluid conduit. In certain embodiments, the at least one heat exchanger includes a reject heat exchanger exposed to the ambient environment; and the at least one forced convection unit is arranged to enhance dissipation of heat from the reject heat exchanger to the ambient environment. In certain embodiments, the reject heat exchanger includes a plurality of fins, and the fluid conduit is in conductive thermal communication with the plurality of fins.

With continued reference to the heat transport system of the preceding two paragraphs, in certain embodiments the heat transport system may include at least one thermoelectric heat pump arranged to receive heat from the fluid conduit and transport heat to the reject heat exchanger, wherein the at least one thermoelectric heat pump is operated responsive to temperature of the chamber or surface. In certain embodiments, the at least one thermoelectric heat pump includes a plurality of thermoelectric heat pumps, and the controller is arranged to separately control at least two thermoelectric heat pumps of the plurality of thermoelectric heat pumps. In certain embodiments, the at least one heat exchanger comprises an accept heat exchanger arranged between the chamber or surface and the fluid conduit, and the at least one forced convection unit is arranged to enhance transfer of heat from the chamber or surface to the accept heat exchanger. In certain embodiments, a condition indicative of a state in which temperature of an ambient environment exceeds an ambient environment threshold temperature of ambient environment threshold temperature range is detected by sensing a temperature of the at least one heat exchanger.

Certain embodiments of the present disclosure relate to a method of controlling a heat transport system to maintain a set point temperature or set point temperature range of a chamber or surface, with the heat transport system in thermal communication with the at least one heat exchanger, and at least one forced convection unit that is selectively operable to enhance convective heat transfer relative to the at least one heat exchanger. Such a method may include multiple steps, such as: receiving temperature data indicative of at least one of (i) temperature of an ambient environment containing the heat transport system, and (ii) temperature of the chamber or surface; activating the at least one forced convection unit upon detection of at least one condition indicative of at least one of the following states (a) and (b): (a) temperature of the chamber or surface exceeds a steady state temperature range that includes the set point temperature or set point temperature range, and (b) temperature of an ambient environment exceeds an ambient environment threshold temperature or ambient environment threshold temperature range; and deactivating the at least one forced convection unit upon detection of a condition indicative of at least one of the following states (I) and (II): (I) temperature of the chamber or surface is within the steady state temperature range, and (II) temperature of an ambient environment is below the ambient environment threshold temperature or ambient environment threshold temperature range. In certain embodiments, the heat transport fluid includes a liquid, and the method further comprises using a pump (or other liquid pressurizing element) for pumping the heat transport fluid within the fluid conduit. In certain embodiments, the at least one heat exchanger comprises a reject heat exchanger exposed to the ambient environment; the at least one forced convection unit is arranged to enhance dissipation of heat from the reject heat exchanger to the ambient environment; the heat transport system comprises at least one thermoelectric heat pump arranged to receive heat from the fluid conduit and transport heat to the reject heat exchanger; and the method further comprises selectively controlling the at least one forced convection unit responsive to temperature of the chamber or surface. In certain embodiments, the at least one heat exchanger comprises an accept heat exchanger arranged between the chamber or surface and the fluid conduit; the at least one forced convection unit is arranged to enhance transfer of heat from the chamber or surface to the accept heat exchanger; the heat transport system comprises at least one thermoelectric heat pump arranged to receive heat from the accept heat exchanger; and the method further comprises selectively controlling the at least one forced convection unit responsive to temperature of the chamber or surface.

Additional aspects of the disclosure are directed to reject heat transport apparatuses that include first and second reject heat sinks each coupled via main and crossover transport tubes to first and second reject heat exchangers. In particular, multiple reject heat sinks are arranged in thermal communication, via main and crossover reject transport tubes, with multiple heat exchangers each having a plurality of fins and each coupled to at least one different thermoelectric heat pump. All reject heat sinks are arranged to dissipate heat from each thermoelectric heat pump regardless of whether the thermoelectric heat pumps are operated separately or together. In an embodiment including first and second heat sinks, both heat sinks are arranged to dissipate heat from first and second thermoelectric heat pumps regardless of whether the first, the second, or the first and second heat pumps are in operation. As compared to use of reject heat sinks that are dedicated to separate heat exchangers (each having dedicated thermoelectric coolers), the greater surface area associated with the multiple reject heat sinks enhances heat transfer and results in lower temperature at the thermoelectric heat pump(s) in operation.

One embodiment of a heat transport apparatus according to the present disclosure is illustrated in FIGS. 11-12, while FIG. 10 illustrates independent first and second heat transport devices (each including a heat sink, a heat exchange pad, and heat transport conduit) that provide a basis for comparing the apparatus of FIGS. 11-12. Before discussing the heat transport apparatus of FIGS. 11-12 and the independent devices of FIG. 10, context for such elements is briefly introduced below.

Conventional refrigeration systems have two primary design modes: high usage/pull-down (emphasizing high power input and high heat transport capacity over energy efficiency) and steady state (involving lower power input with a greater emphasis on energy efficiency). In thermoelectric refrigeration systems, meeting requirements for high heat transport under high usage/pull down conditions and requirements for high efficiency under steady state conditions tends to favor providing two separate heat pumps (each including multiple TECs), wherein one thermoelectric heat pump is used during steady state conditions, and both thermoelectric heat pumps are used during high heat transport conditions. In such a traditional design, each thermoelectric heat pump has its own dedicated heat dissipating components (e.g., heat sink(s)) for rejecting heat, without thermal communication between heat dissipating components associated with different thermoelectric heat pumps.

FIG. 10 illustrates independent first and second heat transport devices 415, 415'. The first heat transport device 415 includes a first heat exchange pad 414 that may be positioned to receive heat from the hot side of a first thermoelectric cooling element (not shown), a first heat sink embodying multiple arrays of fins 417A, 417B, and heat transport tubes 416A-416D arranged to transport heat from the first heat exchange pad 414 to the first heat sink (i.e., the arrays of fins 417A, 417B). The second heat transport device 415' includes a second heat exchange pad 414' that may be positioned to receive heat from the hot side of a second thermoelectric cooling element (not shown), a second heat sink embodying multiple arrays of fins 417A', 417B', and heat transport tubes 416A'-416D' arranged to transport heat from the second heat exchange pad 414' to the second heat sink (i.e., the arrays of fins 417A', 417B'). No components of the first heat transport device 415 are in conductive thermal communication with any components of the second heat transport device 415'. When the first and second heat transport devices 415, 415' are arranged to receive heat from first and second thermoelectric heat pumps (not shown), respectively, and the first and second heat pumps are energized, temperatures of the respective heat sinks are fairly uniform, with a temperature differences generally in a range of 0.5° C.-1.0° C. depending on location from top to bottom. However, when only one thermoelectric heat pump is energized, temperature differences between heat sinks associated with the different thermoelectric heat pumps can rise to 5° C.-7° C. or more. Another shortcoming of the design of FIG. 10 is that the heat exchange pads 414, 414' are spaced apart farther than may be desirable.

FIGS. 11 and 12 illustrate a heat transport apparatus 515 according to one embodiment of the present disclosure. The heat transport apparatus 515 includes first and second heat exchange pads 514-1, 514-2 that may be positioned to receive heat from the hot sides of first and second thermoelectric heat pumps (not shown), respectively, of a thermoelectric cooling or refrigeration system. A first (upper) heat sink includes multiple arrays of fins 517-1A, 517-1B that are coupled to the first heat exchange pad 514-1 via main heat transport tubes 516-1A through 516-1D, and that are also coupled to the second heat exchange paid 514-2 via crossover heat transport tubes 518-2A, 518-2B. A second (lower) heat sink includes multiple arrays of fins 517-2A, 517-2B that are coupled to the second heat exchange pad 514-2 via main heat transport tubes 516-2A through 516-2D, and that are also coupled to the first heat exchange paid 514-1 via crossover heat transport tubes 518-1A, 518-1B. The preceding fins are preferably vertically oriented. Each heat transport tube preferably includes a heat transport fluid and may be arranged for passive heat transport (e.g., such as may be embodied in a heatpipe or thermosiphon). As shown in FIG. 12, each fin of the upper arrays of fins 517-1A, 517-1B is laterally offset from other fins within the respective array, includes multiple holes or openings 522-1 extending through faces of the vertically oriented fins to permit lateral movement or migration of air between respective fins, is of a modified generally rectangular shape including a flat bottom 519-1, flat sides, and a generally arc-shaped top including a rounded portion 523-1 and an angled portion 524-1. As further shown in FIG. 12, each fin of the lower arrays of fins 517-2A, 517-2B is laterally offset from other fins of the respective array, includes multiple holes or openings 522-2 extending through faces of the vertically oriented fins to permit lateral movement or migration of air between respective fins, and is of a generally rectangular shape including a flat bottom 519-1, flat sides, and a flat top 525-2. As illustrated in FIGS. 11 and 12, a central recess or valley extending in a generally vertical direction is provided between arrays of the upper arrays of fins 517-1A, 517-1B and arrays of the lower arrays of fins 517-2A, 517-2B to permit fans or other forced convection units (such as illustrated in FIGS. 15 and 16) to be arranged between respective arrays and proximate to the first and second heat exchange pads 514-1, 514-2.

The heat transport apparatus 515 of FIGS. 11 and 12 permits all reject heat sinks (including arrays 517-1A, 517-1B, 517-2A, 517-2B) to dissipate heat from each thermoelectric heat pump (not shown) in thermal communication with the first and second heat exchange pads 514-1, 514-2 regardless of whether the thermoelectric heat pumps are operated separately or together. As compared to use of heat transport devices 415, 415' according to FIG. 10, the greater surface area associated with the multiple reject heat sinks in thermal communication with both the first and second heat exchange pads 514-1, 514-2 enhances heat dissipation and results in lower temperature at the thermoelectric heat pumps in operation, particularly under conditions when only a single thermoelectric heat pump is operated. In testing performed by the applicants, a heat transport apparatus 515 according to FIGS. 11 and 12 has been shown to provide an efficiency improvement of approximately 18% compared to use of the two heat transport devices 414, 414' according to FIG. 10.

Consistent with the preceding discussion, in certain embodiments a heat transport apparatus arranged to maintain a set point temperature includes: a first reject heat exchanger in conductive thermal communication with a first thermoelectric heat pump arranged to receive heat from the chamber; a second reject heat exchanger in conductive thermal communication with a second thermoelectric heat pump arranged to receive heat from the chamber; a first reject heat sink comprising a first plurality of fins; a second reject heat sink comprising a second plurality of fins; and a plurality of reject transport tubes including: at least one first main reject transport tube arranged to transport heat from the first reject heat exchanger to the first reject heat sink; at least one first crossover reject transport tube arranged to transport heat from the first reject heat exchanger to the second reject heat sink; at least one second main reject transport tube arranged to transport heat from the second reject heat exchanger to the second reject heat sink; and at least one second crossover reject transport tube arranged to transport heat from the second reject heat exchanger to the first reject heat sink.

With continued reference to the heat transport apparatus of the preceding paragraph, in certain embodiments each reject transport tube of the plurality of reject transport tubes comprises a thermosiphon or a heatpipe. In certain embodiments, the apparatus further includes a controller arranged to receive temperature data indicative of a temperature of the chamber, and to selectively control the first thermoelectric heat pump and the second thermoelectric heat pump responsive to the temperature data. In certain embodiments, the apparatus further includes at least one forced convection unit that is selectively operable to enhance convective heat transfer relative to at least one of the first reject heat sink and the second reject heat sink. In certain embodiments, each of the first plurality of fins and the second plurality of fins comprises vertically oriented fins that are disposed in an array, that are laterally offset relative to other fins in the respective array, and that are in conductive thermal communication with multiple reject transport tubes of the plurality of reject transport tubes. In certain embodiments, the vertically oriented fins include multiple open apertures defined in faces of the vertically oriented fins. In certain embodiments, the first thermoelectric heat pump includes a first plurality of thermoelectric cooling elements, and the second thermoelectric heat pump includes a second plurality of thermoelectric cooling elements. Additional embodiments are directed to a thermoelectric cooling or refrigeration system comprising the heat transport apparatus.

FIG. 13 illustrates of a heat accepting apparatus 600 including a heat exchange block 610, first and second accept loops 608, 609 coupled to the heat exchange block 610, and an interconnect line 601 according to one embodiment of the present disclosure (such as may be used with a thermoelectric refrigeration unit as depicted in FIGS. 15 and 16). FIG. 14 illustrates internal elements of the heat exchange block 610 (which may be formed of aluminum, copper, or another suitable metal). The heat exchange block 610 includes four longitudinal fluid ports 611 that may be formed by drilling or other suitable cavity forming means, yielding a crowned portion at the terminus 612 of each longitudinal fluid port 611. Respective ends of the first and second accept loops 608, 609 are received by the four longitudinal fluid ports 611. Near the termini 612, an interconnect port 613 extends laterally through the longitudinal fluid ports 611 and may be formed by drilling or other suitable cavity forming means. The interconnect line 601 is coupled to the interconnect port 613 and is terminated at opposing ends by fittings 602A, 602B that permit heat transport fluid to be added to (or removed from) the accept loops 608, 609. Each accept loop 608, 609 is preferably arranged for passive transport of heat transport fluid, and may embody a thermosiphon or heatpipe. In certain embodiments, the first accept loop 608 may be arranged along sides of a cooling chamber, and the second accept loop 609 may be arranged along a rear wall of a cooling chamber.

FIG. 15 is a perspective assembly view of a thermoelectric refrigeration unit, and FIG. 16 illustrates the thermoelectric refrigeration unit 700 following assembly thereof. A cooling chamber 702 is bounded by an interior wall 703 and a door 704. An outer wall 701 surrounds the interior wall 703, with insulation (not shown) preferably being arranged between the interior wall 703 and outer wall 701. The outer wall 701 may form a box or cabinet supported from below by legs or casters 790. Accept loops 708-1, 709-1 are arranged along upper lateral and upper rear portions of the interior wall 703, and accept loops 708-2, 709-2 are arranged along lower lateral and lower rear portions of the interior wall 703, to receive heat from the cooling chamber 702. Each accept loop 708-1, 709-1, 708-2, 709-2 is preferably arranged for passive transport of heat transport fluid (e.g., may embody a thermosiphon or heatpipe). The upper accept loops 708-1, 709-1 are coupled to an upper heat exchange block (not shown) arranged in thermal communication with (e.g., pressed against) a first thermoelectric heat pump 712-1 including multiple TECs, such as may be arranged in a cartridge as described herein. Similarly, the lower accept loops 708-2, 709-2 are coupled to a lower heat exchange block (not shown) arranged in thermal communication with a second thermoelectric heat pump 712-2 including multiple TECs, such as may be arranged in cartridge as described herein. The thermoelectric heat pumps 712-1, 712-2 may be arranged along an insulated portion 772 of a rear surface 771. A heat transport apparatus 515 (as illustrated in FIGS. 11 and 12) may be arranged along the insulated portion 772 of the rear surface 771, with the first heat exchange pad 514-1 arranged in thermal communication with (e.g., pressed against) the first thermoelectric heat pump 712-1, and with the second heat exchange pad 514-2 arranged in thermal communication with the second thermoelectric heat pump 712-2. First and second fans 721-1, 721-2 may be arranged in the central recess or valley (that extends in a generally vertical direction between left and right arrays of fins 517-1A, 517-1B, 517-2A, 517-2B of the heat transport apparatus 515. A cover 735 may be arranged over the heat transport apparatus 515 and fans 721-1, 721-2. The cover 735 includes perforated face panel portions 740A, 740B and side walls 739A, 739B arranged to abut the arrays of fins 517-1A, 517-1B, 517-2A, 517-2B. A central panel portion 736 includes apertures 738-1, 738-2 arranged to fit over the fans 721-1, 721-2 as well as top and bottom medial wall portions 738-1. Openings 741A, 741B are provided along top and bottom portions of the cover 735 between the medial wall portions 737 and the side walls 739A, 739B to expose top surfaces of fins of the upper arrays of fins 517-1A, 517-1B and to expose bottom surfaces of fins of the lower arrays of fins 517-2A, 517-2B.

To determine a best configuration for the fans 721-1, 721-2 of the thermoelectric refrigeration unit 700, testing was performed (at 25° C. ambient with ~35 W total input power to thermoelectric heat pumps, with the fans supplied input power of 2.4 W (0.15 amps at 12 volts). Various combinations of the individual fans blowing in, blowing out, and off were tested. Ultimately, configuring both fans blowing outward (away from the thermoelectric heat pumps) was found to yield better results than any other configuration, providing the lowest top, bottom, and average hot side thermoelectric heat pump surface temperatures.

In operation of the thermoelectric refrigeration unit 700 of FIGS. 15 and 16, the thermoelectric heat pumps 712-1, 712-2 are energized, thereby cooling the accept loops 708-1, 709-1, 708-2, and 709-2 to receive heat from the cooling chamber 702. Heat accepted by the accept loops 708-1, 709-1, 708-2, and 709-2 is transported to the thermoelectric heat pumps 712-1, 712-2, and is received by the heat transport apparatus 515 for dissipation (by the arrays of fins 517-1A, 517-1B, 517-2A, and 517-2B) to an ambient environment. The fans 721-1, 721-2 may be energized (as described previously herein) to draw air across the arrays of fins 517-1A, 517-1B, 517-2A, and 517-2B to enhance convective heat transport when necessary (such as during pull down/recovery or abnormally high ambient temperature conditions), but the fans 721-1, 721-2 may be de-energized during steady state operation when passive heat transport is preferably sufficient to maintain a desired set point temperature in the cooling chamber 702.

Those skilled in the art will recognize improvements and modifications to the preferred embodiments of the present disclosure. All such improvements and modifications are considered within the scope of the concepts disclosed herein and the claims that follow. Any of the various features and elements as disclosed herein may be combined with one or more other disclosed features and elements unless indicated to the contrary herein.

What is claimed is:

1. A heat transport system arranged to maintain a set point temperature or set point temperature range of a chamber or surface of a refrigeration system, the heat transport system comprising:

at least one heat exchanger;

a fluid conduit containing a heat transport fluid in thermal communication with the at least one heat exchanger where the heat transport fluid comprises a liquid phase and a gas phase within the fluid conduit, and is arranged for passive flow within the fluid conduit;

at least one forced convection unit that is selectively operable to enhance convective heat transfer relative to the at least one heat exchanger; and a controller configured to:

receive temperature data indicative of a temperature of an ambient environment external to the refrigeration system;

activate the at least one forced convection unit upon detection of a condition indicative that the temperature of the ambient environment external to the refrigeration system exceeds an ambient environment threshold temperature or ambient environment threshold temperature range; and deactivate the at least one forced convection unit upon detection that the temperature of the ambient environment external to the refrigeration system is below the ambient environment threshold temperature or ambient environment threshold temperature range.

2. The heat transport system of claim 1, wherein the fluid conduit comprises a thermosiphon or a heatpipe.

3. The heat transport system of claim 1, wherein:

the at least one heat exchanger comprises a reject heat exchanger exposed to the ambient environment external to the refrigeration system; and the at least one forced convection unit is arranged to enhance dissipation of heat from the reject heat exchanger to the ambient environment external to the refrigeration system.

4. The heat transport system of claim 3, wherein the reject heat exchanger comprises a plurality of fins, and wherein the fluid conduit is in conductive thermal communication with the plurality of fins.

5. The heat transport system of claim 3, wherein the heat transport system comprises at least one thermoelectric heat pump arranged to receive heat from the fluid conduit and transport heat to the reject heat exchanger, and the at least one thermoelectric heat pump is operated responsive to the temperature of the chamber or surface.

6. The heat transport system of claim 5, wherein the at least one thermoelectric heat pump comprises a plurality of thermoelectric heat pumps, and the controller is configured to separately control at least two thermoelectric heat pumps of the plurality of thermoelectric heat pumps.

7. The heat transport system of claim 1, wherein the at least one heat exchanger comprises an accept heat exchanger arranged between the chamber or surface and the fluid conduit, and the at least one forced convection unit is arranged to enhance transfer of heat from the chamber or surface to the accept heat exchanger.

8. The heat transport system of claim 1, wherein the condition indicative of a state in which the temperature of the ambient environment external to the refrigeration system exceeds the ambient environment threshold temperature or ambient environment threshold temperature range is detected by sensing a temperature of the at least one heat exchanger.

9. The heat transport system of claim 1, wherein the at least one forced convection unit comprises an electrically operated fan.

* * * * *